US008013850B2

(12) United States Patent
Yamazaki

(10) Patent No.: US 8,013,850 B2
(45) Date of Patent: Sep. 6, 2011

(54) ELECTROOPTIC DEVICE, DRIVING CIRCUIT, AND ELECTRONIC DEVICE

(75) Inventor: Katsunori Yamazaki, Matsumoto (JP)

(73) Assignee: Sony Corporation, Tokyo (JP)

( * ) Notice: Subject to any disclaimer, the term of this patent is extended or adjusted under 35 U.S.C. 154(b) by 1064 days.

(21) Appl. No.: 11/882,950

(22) Filed: Aug. 7, 2007

(65) Prior Publication Data

US 2008/0055300 A1 Mar. 6, 2008

(30) Foreign Application Priority Data

Sep. 1, 2006 (JP) ..... 2006-237367

(51) Int. Cl.
*G06F 3/038* (2006.01)
*G09G 5/00* (2006.01)
*G02F 1/133* (2006.01)

(52) U.S. Cl. ..... 345/212; 345/211; 345/213; 345/214; 349/23

(58) Field of Classification Search ..... 345/208–214, 345/94–96, 84; 349/33, 37
See application file for complete search history.

(56) References Cited

U.S. PATENT DOCUMENTS

2006/0119755 A1 6/2006 Senda et al.

FOREIGN PATENT DOCUMENTS

| | | |
|---|---|---|
| JP | A 2001-83943 | 3/2001 |
| JP | A-2001-282205 | 10/2001 |
| JP | A-2003-150127 | 5/2003 |
| JP | A-2006-154545 | 6/2006 |

*Primary Examiner* — Sumati Lefkowitz
*Assistant Examiner* — Jonathan Horner
(74) *Attorney, Agent, or Firm* — K&L Gates LLP

(57) ABSTRACT

A driving circuit of an electrooptic device includes: a plurality of scanning lines; a plurality of data lines; first and second capacitor lines; a common electrode; pixels; a scanning-line driving circuit; a capacitor-line driving circuit; and a data-line driving circuit. The pixels each include: a pixel switching element; a pixel capacitor disposed between the pixel switching element and the common electrode; and a storage capacitor. When the one scanning line is selected, the capacitor-line driving circuit shifts the voltage of a first (or second) capacitor line corresponding to one scanning line to one of higher and lower levels from a predetermined voltage by a predetermined value, and holds the predetermined voltage after a scanning line apart from the one scanning line by a predetermined number of lines is selected until the one scanning line is selected again.

4 Claims, 18 Drawing Sheets

FIG. 7A
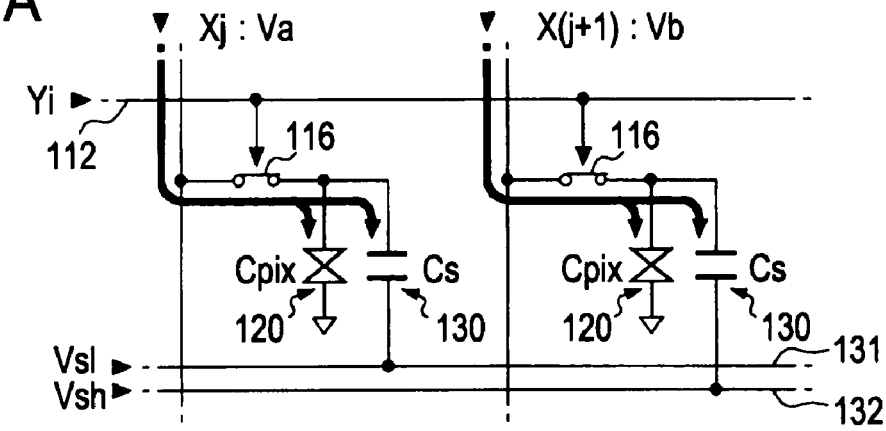
FIG. 7B
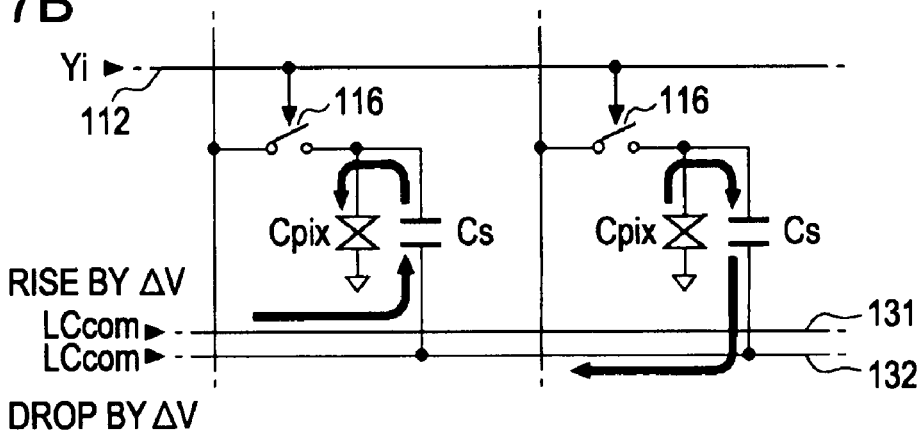
FIG. 8A
FIG. 8B
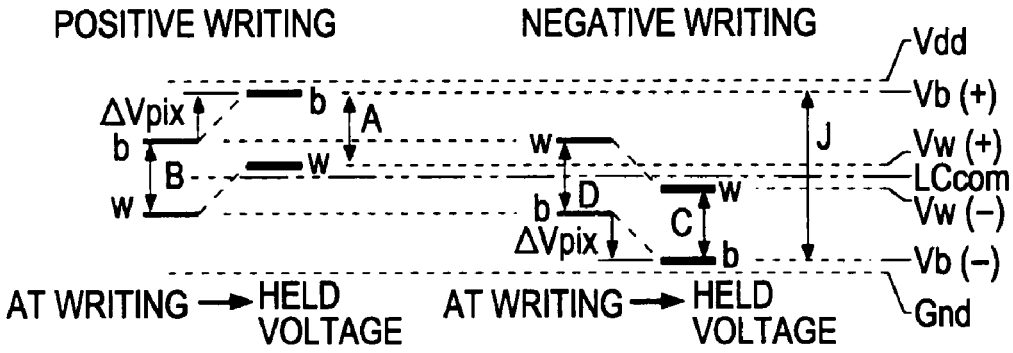

ELECTROOPTIC DEVICE, DRIVING CIRCUIT, AND ELECTRONIC DEVICE

BACKGROUND

1. Technical Field

The present invention relates to a technique for electrooptic devices such as liquid crystal devices to reduce the voltage amplitude of the data lines and to achieve high-definition display.

2. Related Art

Electrooptic devices such as liquid crystal devices have pixel capacitors (liquid-crystal capacitors) corresponding to the intersections of scanning lines and data lines. When there is a need to drive the pixel capacitors by an alternating current, the components of a data-line driving circuit which provides data signals to the data lines are required to have resistance to voltage corresponding to the voltage amplitude of the data signals, because the voltage amplitude has positive and negative polarities. To meet this need, there is proposed a technique for reducing the voltage amplitude of the data signals by providing storage capacitors in parallel to the pixel capacitors and by driving capacitor lines connected to a common storage capacitor in synchronism with the selection of a scanning line in binary (refer to JP-A-2001-83943).

However, since this technique employs a structure in which a capacitor-line driving circuit and a scanning-line driving circuit (substantially, a shift register) share the same lines, the circuit configuration for driving the capacitor lines are complicated.

SUMMARY

An advantage of some aspects of the invention is to provide an electrooptic device, a driving circuit thereof, and an electronic device which can achieve high-definition display while partly reducing the voltage amplitude of the data lines with a simple circuit configuration.

According to a first aspect of the invention, there is provided a driving circuit of an electrooptic device, comprising: a plurality of scanning lines; a plurality of data lines; first and second capacitor lines corresponding to each of the plurality of scanning lines; a common electrode; pixels corresponding to the intersections of the plurality of scanning lines and the plurality of data lines; a scanning-line driving circuit that selects the scanning lines in a predetermined order; a capacitor-line driving circuit; and a data-line driving circuit that applies a data signal to pixels corresponding to a selected scanning line via a data line, the data signal having a voltage corresponding to the gray level of the pixels corresponding to the selected scanning line. The pixels each include a pixel switching element connected at one end to a data line corresponding to the element itself, and brought into conduction when a scanning line corresponding to the element itself is selected; a pixel capacitor disposed between the pixel switching element and the common electrode; and a storage capacitor disposed between one end of the pixel capacitor and one of the first and second capacitor lines corresponding to the scanning line. When the one scanning line is selected, the capacitor-line driving circuit shifts the voltage of a first capacitor line corresponding to one scanning line to one of higher and lower levels from a predetermined voltage by a predetermined value, and holds the predetermined voltage after a scanning line apart from the one scanning line by a predetermined number of lines is selected until the one scanning line is selected again. When the one scanning line is selected, the capacitor-line driving circuit shifts the voltage of a second capacitor line corresponding to the one scanning line to the other one of higher and lower levels from the predetermined voltage by the predetermined value, and holds the predetermined voltage after a scanning line apart from the one scanning line by a predetermined number of lines is selected until the one scanning line is selected again. Thus, the voltage amplitude of the data lines can be reduced with a simple configuration, and the voltage to be written to the pixel capacitors can be changed depending on whether the storage capacitor is connected to the first capacitor line or the second capacitor line, thus allowing high-definition display. Furthermore, since the potentials of the first and second capacitor lines are held, the influence of noise can be eliminated.

Preferably, in the pixels corresponding to the plurality of scanning lines, storage capacitors corresponding odd-numbered columns are each disposed between one end of a pixel capacitor corresponding to the pixel itself and the first capacitor line; and storage capacitors corresponding to even-numbered columns are each disposed between one end of a pixel capacitor corresponding to the pixel itself and the second capacitor line. Preferably, in the pixels corresponding to the plurality of scanning lines, storage capacitors corresponding to odd-numbered rows and odd-numbered columns and to even-numbered rows and even-numbered columns are each disposed between one end of a pixel capacitor corresponding to the pixel itself and the first capacitor line; and storage capacitors corresponding to odd-numbered rows and even-numbered columns and to even-numbered rows and odd-numbered columns are each disposed between one end of a pixel capacitor corresponding to the pixel itself and the second capacitor line. This configuration allows dot reversing in which the written polarity of pixels is reversed alternately every row and column. In this embodiment, the term, odd number and the even number, is merely a relative concept for alternately specifying the successive rows and columns. Similarly, the first and second capacitor lines are merely a concept for specifying either of two capacitor lines per one row.

When the one scanning line is selected, the capacitor-line driving circuit may connect the first capacitor line corresponding to the one scanning line to one of a first feed line that feeds a first capacitance signal and a second feed line that feeds a second capacitance signal, may connect the second capacitor line corresponding to the one scanning line to the other one of the first feed line and the second feed line, and may connect the first capacitor line and the second capacitor line to a third feed line after a scanning line apart from the one scanning line by a predetermined number of lines is selected until the one scanning line is selected again. In this configuration, the voltages of the first and second capacitance signals may be higher or lower voltage exclusively from each other, and may be switched every time one scanning line is selected; and the voltage of the third capacitor line may be the predetermined voltage and in the center of the lower voltage and the higher voltage. The voltages of the first and second capacitance signals may be higher or lower voltage exclusively from each other, and may be switched alternately every period of one or a plurality of frames; and the voltage of the third capacitance signal may be temporally constant at the center of the lower voltage and the higher voltage. In this configuration, the capacitor-line driving circuit may comprise first to sixth transistors corresponding to each row. The gate electrode of the first transistor corresponding to each of the first and second capacitor lines may be connected to a scanning line corresponding to the one scanning line, and the source electrode of the first transistor may be connected to one of the first and second feed lines. The gate electrode of the second transistor may be connected to the scanning line corresponding to the one scanning line, and the source electrode of the second transistor may be connected to the other one of the first and second feed lines. The source electrodes of the third and fourth transistors may be connected to the third feed line. The gate electrode of the fifth transistor may be connected to the scanning line corresponding to the one capacitor line, and the source electrode of the fifth transistor may be connected to an off-voltage feed line that feeds off-voltage for turning off the third and fourth transistors. The gate electrode of the sixth transistor may be connected to a scanning line apart from the scanning line corresponding to the one capacitor line by predetermined lines, and the source electrode of the sixth transistor may be connected to an on-voltage feed line that feeds on-voltage for turning on the third and fourth transistors. The drain electrodes of the first and third transistors may be connected to the first capacitor line corresponding to the line. The drain electrodes of the second and fourth transistors may be connected to the second capacitor line corresponding to the line. The drain electrodes of the fifth and sixth transistors may be connected to the gate electrodes of the third and fourth transistors.

According to a second aspect of the invention, there is provided a driving circuit of an electrooptic device comprising: a plurality of scanning lines; a plurality of data lines; first and second capacitor lines corresponding to each of the plurality of scanning lines; a common electrode; pixels corresponding to the intersections of the plurality of scanning lines and the plurality of data lines; a scanning-line driving circuit that selects the scanning lines in a predetermined order; a capacitor-line driving circuit that applies the common signal to a first capacitor line corresponding to one of scanning lines in odd-numbered rows and even-numbered rows of the plurality of scanning lines, and shifts the voltage of a second capacitor line corresponding to the one scanning line to one of higher and lower levels from the voltage of the common signal by a predetermined value when a scanning line corresponding to the second capacitor itself is selected, and holds the voltage of the common signal after a scanning line apart from the one scanning line by a predetermined number of lines is selected until the one scanning line is selected again; and a data-line driving circuit that applies a data signal to pixels corresponding to a selected scanning line via a data line, the data signal having a voltage corresponding to the gray level of the pixels corresponding to the selected scanning line. The pixels each include: a pixel switching element connected at one end to a data line corresponding to the element itself, and brought into conduction when a scanning line corresponding to the element itself is selected; a pixel capacitor disposed between the pixel switching element and the common electrode to which a common signal is applied; and a storage capacitor disposed between one end of the pixel capacitor and one of the first and second capacitor lines corresponding to the scanning line. The common signal is switched alternately between lower voltage and higher voltage every period of one or a plurality of frames. This configuration also allows high-definition display, and eliminates the influence of noise.

In this configuration, the capacitor-line driving circuit may apply the common signal to a first capacitor line corresponding to the other one of scanning lines in odd-numbered rows and even-numbered rows of the plurality of scanning lines, may shift the voltage of a second capacitor line corresponding to the other scanning line to the other one of voltages higher and lower than the voltage of the common signal by the predetermined value when a scanning line corresponding to the second capacitor itself is selected, and may hold the voltage of the common signal after a scanning line apart from the one scanning line by a predetermined number of lines is selected until the one scanning line is selected again.

The invention may be embodied not only as a driving circuit of an electrooptic device but also as an electrooptic device and an electronic device equipped with the electrooptic device.

BRIEF DESCRIPTION OF THE DRAWINGS

The invention will be described with reference to the accompanying drawings, wherein like numbers reference like elements.

FIG. 7A is a diagram illustrating a voltage writing operation and voltage fluctuations of the electrooptic device.

FIG. 7B is a diagram showing a voltage writing operation and voltage fluctuations of the electrooptic device.

FIG. 8A is a diagram showing the relationship between a data signal and a held voltage of the electrooptic device.

FIG. 8B is a diagram showing the relationship between a data signal and a held voltage of the electrooptic device.

DESCRIPTION OF EXEMPLARY EMBODIMENTS

Embodiments of the invention will be described with reference to the drawings.

First Embodiment

Figure 1:
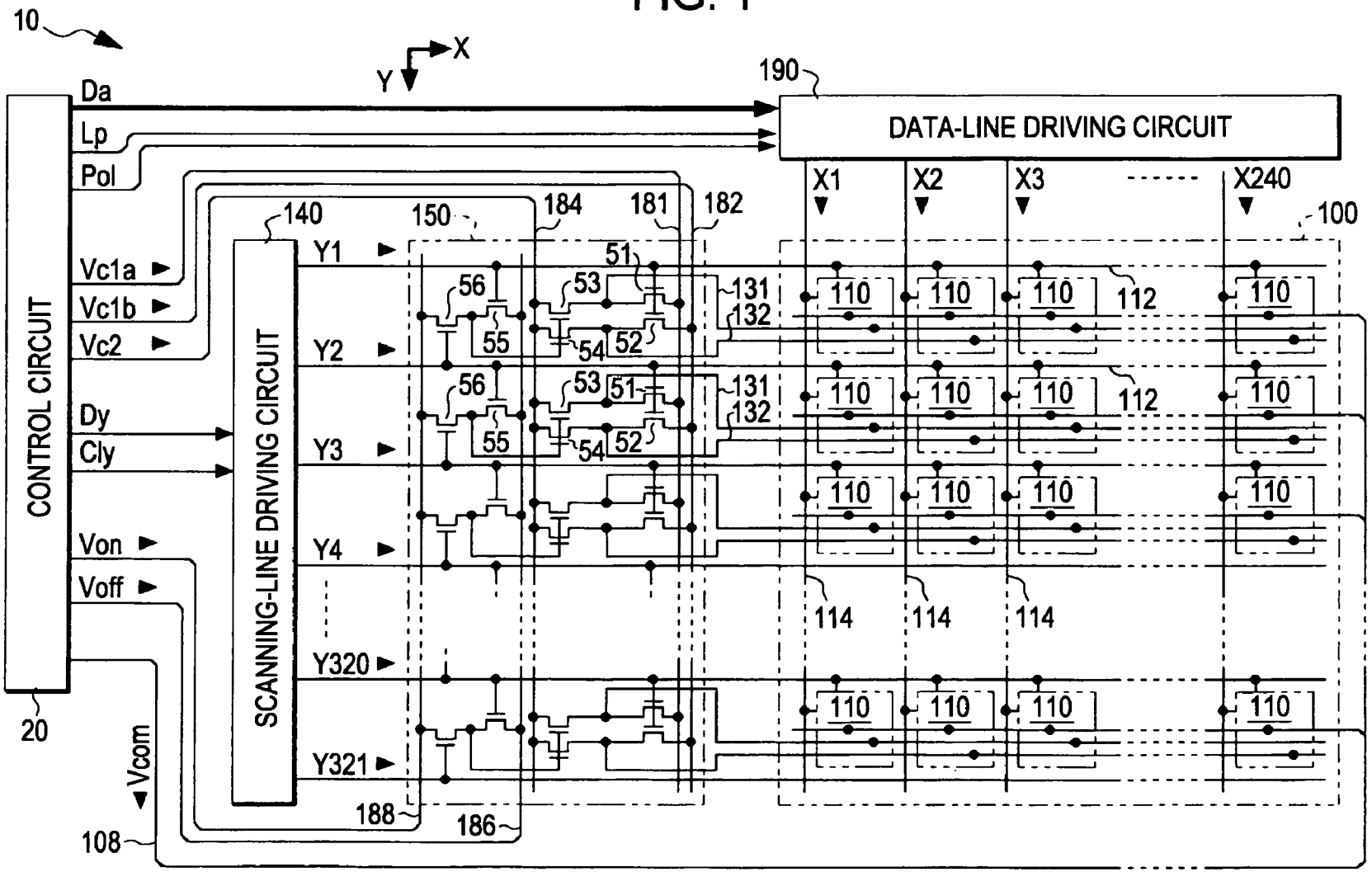
FIG. 1 is a block diagram showing the configuration of an electrooptic device according to a first embodiment of the invention.

A first embodiment of the invention will first be described. FIG. 1 is a block diagram of an electrooptic device according to a first embodiment of the invention.

As shown in the diagram, the electrooptic device, denoted at 10, has a display region 100, and a control circuit 20, a scanning-line driving circuit 140, a capacitor-line driving circuit 150, and a data-line driving circuit 190 around the display region 100. The display region 100 has an array of pixels 110, in which 321 scanning lines 112 extend transversely (in the X direction) and 240 data lines extend longitudinally (in the Y direction). The pixels 110 are disposed at the intersections of the first to $320^{th}$ scanning lines 112 and the first to $240^{th}$ data lines 114. Accordingly, in this embodiment, the pixels 110 are arrayed in a 320 by 240 matrix in the display region 100. The invention is not however limited to that matrix.

In this embodiment, the $321^{st}$ scanning line 112 does not contribute to the vertical scanning of the display region 100 (sequential selection of scanning lines for writing voltage to the pixels 110).

In this embodiment, a pair of first and second capacitor lines 131 and 132 extends in the X direction such that it corresponds to the first to $320^{th}$ scanning lines 112.

The pixels 110 of odd-numbered (first to $239^{th}$) columns correspond to the first capacitor line 131, while the pixels 110 of even-numbered (second to $240^{th}$) columns correspond to the second capacitor line 132. The detailed structure of the pixels 110 will now be described.

Figure 2:
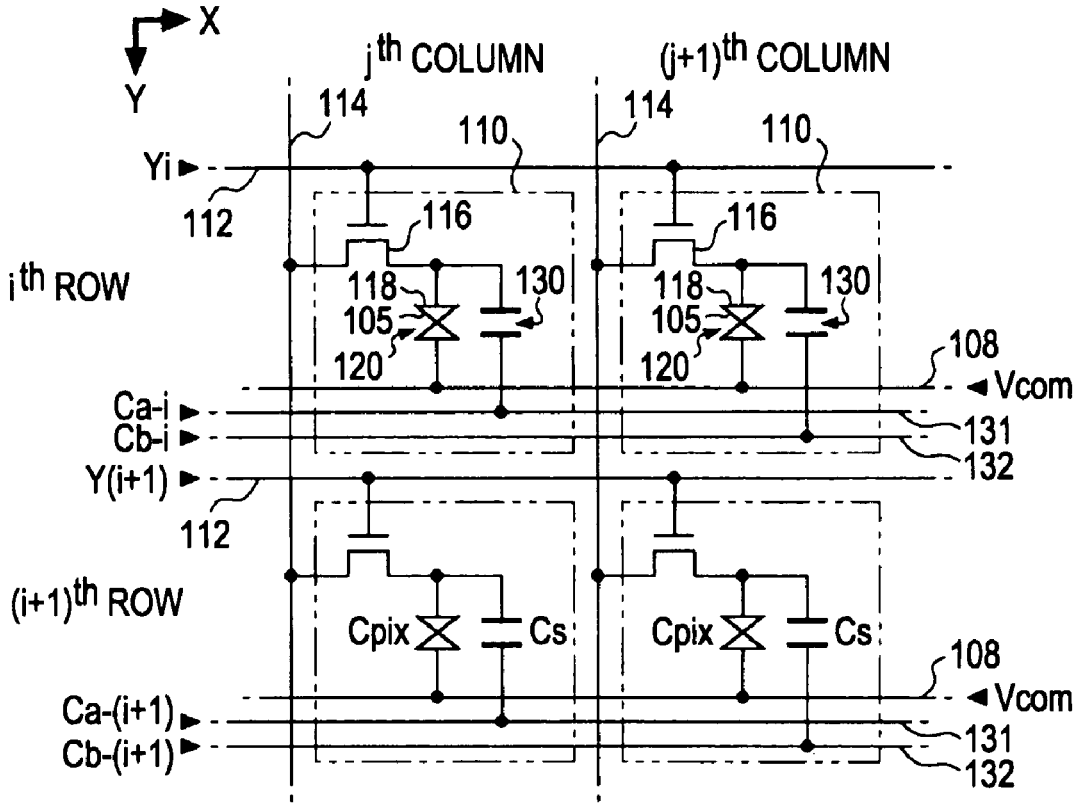
FIG. 2 is a diagram showing the configuration of pixels of the electrooptic device.

FIG. 2 shows the structure of the pixels 110, in which 2×2=4 pixels corresponding to the intersections of the $i^{th}$ row and the adjacent $(i+1)^{th}$ row and the $j^{th}$ column and the adjacent $(i+1)^{th}$ column are shown.

In this embodiment, symbols i and (i+1) denote any continuous two rows of pixels 110, which range from 1 to 320. Here, symbols i and (i+1) of the rows corresponding to the scanning lines 112 are integers from 1 to 321 because the dummy $321^{st}$ line must be included. on the other hand, symbol j denotes any odd-numbered column of the pixels 110, which ranges from 1 to 239. Therefore, (j+1) is an even number ranging from 2 to 240 which is larger than the odd number j by one.

As shown in FIG. 2, each pixel 110 includes an n-channel thin film transistor (hereinafter, simply referred to as a TFT) 116 serving as a pixel switching element, a pixel capacitor (liquid-crystal capacitor) 120, and a storage capacitor 130. Since the pixels 110 have the same structure except the line to which the storage capacitor 130 is connected, the pixel 110 in the $i^{th}$ row and the $j^{th}$ column will be described as a typical example. In the pixel 110 in the $i^{th}$ row and the $j^{th}$ column, the gate electrode of the TFT 116 is connected to the $i^{th}$ scanning line 112, the source electrode is connected to the data line 114 on the $j^{th}$ column, and the drain electrode is connected to a pixel electrode 118 which is a first end of the pixel capacitor 120.

A second end of the pixel capacitor 120 is a common electrode 108. The common electrode 108 is common to all the pixels 110, to which a common signal Vcom is provided, as shown in FIG. 1. The common signal Vcom of this embodiment is a temporally constant voltage LCcom, as will be described later.

The storage capacitor 130 of the pixel 110 in the $i^{th}$ row and the odd-numbered $j^{th}$ column is connected to the pixel electrode 118 (the drain electrode of the TFT 116) at one end and connected to the first capacitor line 131 in the $i^{th}$ row at the other end. The storage capacitor 130 of the pixel 110 in the $i^{th}$ row and the even-numbered $(j+1)^{th}$ column is connected to the pixel electrode 118 at one end, as that of the odd-numbered column, but is connected to the second capacitor line 132 of the $i^{th}$ row at the other end.

The capacitances of the storage capacitors 130 of the odd-numbered column and the even-numbered column are equal, which are expressed as Cs. The capacitance of the pixel capacitor 120 is expressed as Cpix.

In FIG. 2, symbols Yi and Y(i+1) indicate scanning signals provided to the $i^{th}$ and $(i+1)^{th}$ scanning lines 112, respectively, and symbols Ca-i and Cb-i indicate voltages of the first capacitor line 131 and the second capacitor line 132 corresponding to the $i^{th}$ row, respectively.

The display region 100 has a structure in which a pair of substrates, a device substrate having the pixel electrodes 118 and an opposing substrate having the common electrodes 108, are bonded together such that the electrode formed surfaces face with a space therebetween, in which liquid crystal 105 is sealed. Thus, the pixel capacitor 120 sandwiches the liquid crystal 105 which is a kind of dielectric with the pixel electrode 118 and the common electrode 108 and holds the difference voltage between the pixel electrode 118 and the common electrode 108. With this structure, the amount of light transmission of the pixel capacitor 120 changes with the effective value of the held voltage. It is assumed that this embodiment is in a normally white mode in which if the effective voltage held by the pixel capacitor 120 is close to zero, the light transmittance becomes the maximum to provide white display, and the amount of transmission decreases as the effective voltage increases, and it finally becomes the minimum to display in black.

Returning back to FIG. 1, the control circuit 20 outputs various control signals to control the components of the electrooptic device 10, and provides a first capacitance signal Vc1*a* to a first feed line 181, a second capacitance signal Vc1*b* to a second feed line 182, and a third capacitance signal Vc 2*b* to a third feed line 184, respectively. The control circuit 20 provides off-voltage Voff (to be described later) to an off-voltage feed line 186, on-voltage Von (to be described later) to an on-voltage feed line 188, and common signal Vcom to the common electrode 108.

Around the display region 100 are provided peripheral circuits such as the scanning-line driving circuit 140, the capacitor-line driving circuit 150, and the data-line driving circuit 190. Among them, the scanning-line driving circuit 140 provides scanning signals Y1 to Y321 to the first to $321^{st}$ scanning lines 112, respectively, for the period of one frame. Specifically, the scanning-line driving circuit 140 selects the scanning lines in the order from the first to $321^{st}$ row, and provides a scanning signal of a high level corresponding to selected voltage Vdd to a selected scanning line, and a scanning signal of a low level corresponding to unselected voltage (ground potential Gnd) to the other scanning lines.

Figure 4:
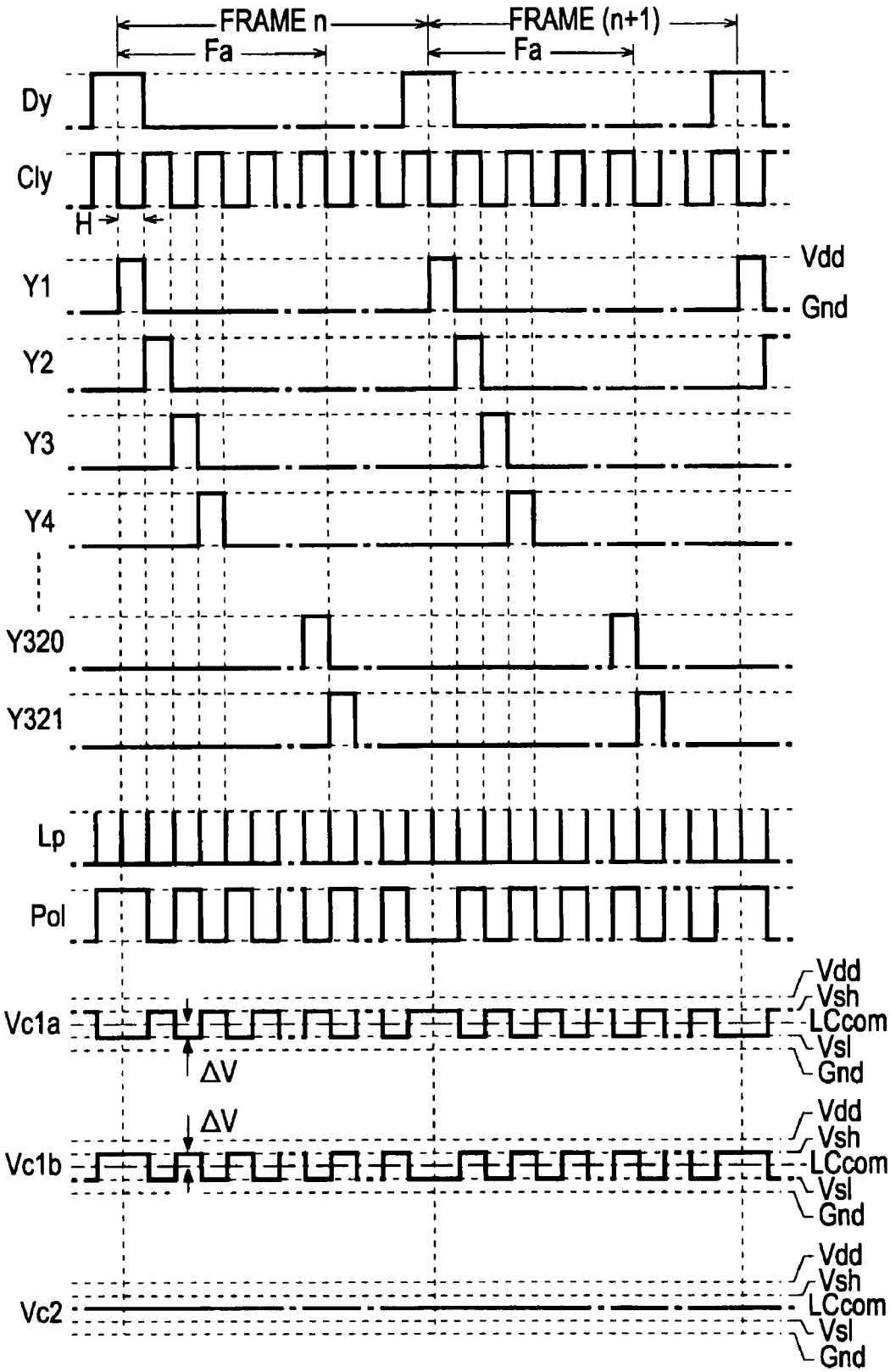
FIG. 4 is a diagram for illustrating the operation of the electrooptic device.

More specifically, as shown in FIG. 4, the scanning-line driving circuit 140 outputs the scanning signals Y1 to Y321 by shifting a start pulse Dy applied from the control circuit 20 according to a clock signal Cly.

As shown in FIG. 4, the period of one frame in this embodiment includes an effective scanning period Fa after the scanning signal Y1 has reached a high level (a high level) until the scanning signal Y320 reaches a low level (a low level) and the other period, that is, the flyback time after the dummy scanning signal Y321 has reached a high level until the scanning signal Y1 goes to a high level again. The period during which one scanning line 112 is selected is a horizontal scanning period H.

The capacitor-line driving circuit 150 of this embodiment includes a set of TFTs 51 to 56 provided for each row. The TFTs 51 to 56 corresponding to the $i^{th}$ row will be described herein. The gate electrode of the TFT 51 (a first transistor) and the gate electrode of the TFT 52 (a second transistor) are connected to the $i^{th}$ scanning line 112 in common, while the source electrode of the TFT 51 is connected to the first feed line 181, and the source electrode of the TFT 52 is connected to the second feed line 182.

The source electrode of the TFT 53 (a third transistor) and the source electrode of the TFT 54 (a fourth transistor) corresponding to the $i^{th}$ row are connected to the third feed line 184 in common. The gate electrode of the TFT 55 (a fifth transistor) corresponding to the $i^{th}$ row is connected to the $i^{th}$ scanning line 112, and the source electrode of the TFT 55 is connected to the off-voltage feed line 186.

The gate electrode of the TFT 56 (a sixth transistor) corresponding to the $i^{th}$ row is connected to the scanning line 112 of the $(i+1)^{th}$ row that is selected next to the $i^{th}$ row, and the source electrode of the TFT 56 is connected to the on-voltage feed line 188.

The common drain electrode of the TFTs 55 and 56 is connected to the common gate electrode of the TFTs 53 and 54. The common drain electrode of the TFTs 51 and 53 corresponding to the $i^{th}$ row is connected to the first capacitor line 131 of the $i^{th}$ row, and the common drain electrode of the TFTs 52 and 54 corresponding to the $i^{th}$ row is connected to the second capacitor line 132 of the $i^{th}$ row.

While we have described the TFTs 51 to 56 of the $i^{th}$ row as a representative example, those of the other rows have the same structure.

The off-voltage Voff applied to the off-voltage feed line 186 is a voltage that turns off the TFTs 53 and 54 when applied to the gate electrode of the TFTs 53 and 54 (that brings the source and drain electrodes out of conduction). The on-voltage Von applied to the on-voltage feed line 188 is a voltage that turns on the TFTs 53 and 54 when applied to the gate electrode of the TFTs 53 and 54 (that brings the source and drain electrode into conduction).

The data-line driving circuit 190 provides data signals X1 to X240 of the voltage corresponding to the gray level of the pixels 110 on the scanning line 112 selected by the scanning-line driving circuit 140 and responsive to a polarity indication signal Pol to the first to $240^{th}$ data lines 114, respectively.

The data-line driving circuit 190 has storage regions (not shown) corresponding to the 320-by 240-pixel matrix array, in each of which display data Da that indicates the gray level (luminosity) of a corresponding pixel 110 is stored. When the display content is changed, the display data Da stored in each storage region is updated to new display data Da given along with its address by the control circuit 20.

The data-line driving circuit 190 executes the operation of reading the display data Da of the pixels 110 on the selected scanning line 112 from the storage region, converting it to a data signal of a voltage corresponding to the gray level and the polarity, and supplying it to the data line 114, for each of the first to $240^{th}$ columns of the selected scanning line 112.

The polarity indication signal Pol of this embodiment indicates, for a high level, positive writing to the pixels in the odd-numbered rows and odd-numbered columns (and in the even-numbered rows and even-numbered columns), and indicates negative writing to the pixels in the odd-numbered rows and even-numbered columns (and in the even-numbered rows and odd-numbered columns); in contrast, for a low level, the polarity indication signal Pol indicates negative writing to the pixels in the odd-numbered rows and odd-numbered columns (and in the even-numbered rows and even-numbered columns), and positive writing to the pixels in the odd-numbered rows and even-numbered columns (and in the even-numbered rows and odd-numbered columns), thus reversing the polarity every horizontal scanning period H of one frame, as shown in FIG. 4. That is, this embodiment adopts dot reversing in which the written polarity is reversed every row and column.

The polarity indication signal Pol of adjacent frames is reversed in logic during a horizontal scanning period in which the same scanning line is selected, that is, it shifts in phase by 180 degrees between the periods of adjacent frames. The reason for reversing the polarity is to prevent the degradation of the liquid crystal due to application of a direct current component. In this embodiment, if the voltage written to the pixel capacitor 120 corresponding to the gray level is higher than that of the common electrode 108, the polarity of the voltage is referred to as positive polarity, and if the voltage is lower, its polarity is referred to as negative polarity. The voltage is based on the ground potential Gnd of the power source, except as otherwise noted.

The control circuit 20 provides a latch pulse Lp to the data-line driving circuit 190 at the timing at which the logic level of the clock signal Cly shifts. Since the scanning-line driving circuit 140 outputs the scanning signals Y1 to Y321 by shifting the start pulse Dy in response to the clock signal Cly or the like, as described above, the timing to start the period during which a scanning line is selected is the timing at which the logic level of the clock signal Cly shifts. Thus, the data-line driving circuit 190 can be notified of a scanning line selected by continuously counting the latch pulse Lp for the period of one frame and of the scanning-line selection start timing by the timing at which the latch pulse Lp is provided.

In this embodiment, the device substrate has, in addition to the scanning lines 112, the data lines 114, the first capacitor lines 131, the second capacitor lines 132, the TFTs 116, the pixel electrodes 118, and the storage capacitors 130 in the display region 100, the TFTs 51 to 56, the first feed line 181, the second feed line 182, and the third feed line 184, the off-voltage feed line 186, and the on-voltage feed line 188 of the capacitor-line driving circuit 150.

Figure 3:
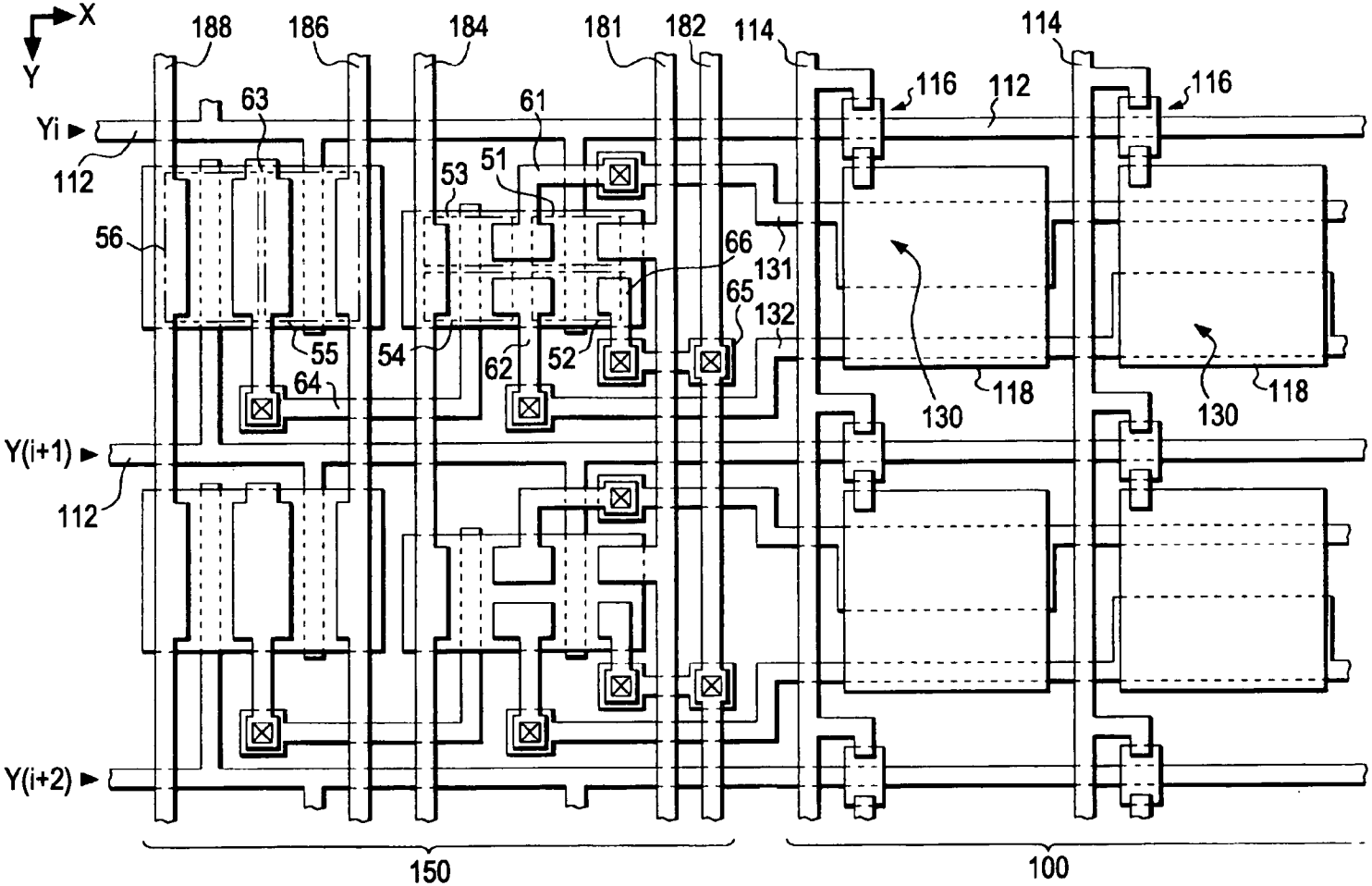
FIG. 3 is a diagram showing the configuration of the boundary between the display region and the capacitor-line driving circuit of the electrooptic device.

FIG. 3 is a plan view of the configuration around the boundary between the capacitor-line driving circuit 150 and the display region 100.

As shown in this drawing, the TFTs 116 and 51 to 56 are of an amorphous silicon type and of a bottom gate type in which their gate electrodes are located lower than the semiconductor layer (on the back of the drawing).

More specifically, a gate electrode layer serving as a first conductive layer is patterned into the scanning lines 112, the first capacitor lines 131, the second capacitor lines 132, and the gate electrodes of the TFTs, on which a gate insulator film (not shown) is formed, and the semiconductor layer of the TFTs is formed like islands.

The semiconductor layer has thereon the rectangular pixel electrodes 118 formed by patterning an indium tin oxide (ITO) layer serving as a second conductive layer, with a protective layer therebetween. The semiconductor layer further has various connecting lines including the source electrodes and the drain electrodes of the TFTs, the data lines 114, the first feed lines 181, the second feed lines 182, the third feed lines 184, the off-voltage feed line 186, and the on-voltage feed line 188 which are formed by patterning a metal layer made of aluminum or the like serving as a third conductive layer.

The scanning lines 112 extend in the X direction in the display region 100, as described above.

The $i^{th}$ scanning line 112 has in the capacitor-line driving circuit 150 two branches extending in the Y direction (downward), one of which serves as the common gate electrode of the TFTs 51 and 52, and the other serves as the gate electrode of the TFT 55. The $i^{th}$ scanning line 112 has an upward branch so as to form the gate electrode of the TFT 56 corresponding to the $(i-1)^{th}$ row one row above (not shown).

The common drain electrode 61 of the TFTs 51 and 53 is formed by patterning the third conductive layer, and is connected to the first capacitor line 131 of the $i^{th}$ row through a contact hole (indicated by x in the drawing) in the protective layer and the gate insulating layer. Similarly, the common drain electrode 62 of the TFT 52 and 54 is connected to the second capacitor line 132 of the $i^{th}$ row through a contact hole.

The second feed line 182 is connected to a line 65 formed by patterning the gate electrode layer through a contact hole provided for each line. The line 65 is further connected to the source electrode 66 of the TFT 52 through a contact hole, the source electrode 66 being formed by patterning the third conductive layer.

The portion (wide portion) of the first feed line 181 overlapping with the semiconductor layer of the TFT 51 serves as the source electrode of the TFT 51, and the portion of the third feed line 184 overlapping with the semiconductor layer of the TFTs 53 and 54 serves as the common source electrode of the TFTs 53 and 54.

The common drain electrode 63 of the TFTs 55 and 56 is formed by patterning the third conductive layer, and is connected to the common gate electrode 64 of the TFTs 53 and 54 through a contact hole.

The portion of the off-voltage feed line 186 overlapping with the semiconductor layer of the TFT 55 serves as the source electrode of the TFT 55, and the portion of the on-voltage feed line 188 overlapping with the semiconductor layer of the TFT 56 serves as the source electrode of the TFT 56.

The storage capacitors 130 corresponding to the pixels on the odd-numbered columns each have the gate insulating layer serving as a dielectric under the pixel electrode 118, the gate insulating layer being sandwiched between the wide portion of the first capacitor line 131 and the pixel electrode 118. The storage capacitors 130 in the even-numbered columns each have the gate insulating layer serving as a dielectric under the pixel electrode 118, the gate insulating layer being sandwiched between the wide portion of the second capacitor line 132 and the pixel electrode 118.

The common electrodes 108 are not shown in FIG. 3 which is a plan view of the device substrate, because they are disposed on an opposing substrate.

FIG. 3 merely shows an example and the TFTs may have another structure; for example, the gate electrodes may be of a top gate type, or the TFTs may be of a polysilicon type in term of process. The elements of the capacitor-line driving circuit 150 may not be disposed in the display region 100 but IC chips may be mounted on the device substrate.

If IC chips are mounted on the device substrate, the scanning-line driving circuit 140 and the capacitor-line driving circuit 150 may be mounted as one semiconductor chip together with the data-line driving circuit 190, or alternatively, they may be separate chips. The control circuit 20 may either be disposed on a separate flexible printed circuit (FPC) board or the like or mounted on the device substrate as a semiconductor chip.

If this embodiment is not of a transmissive type but of a reflective type, the pixel electrode 118 may be a reflective conductor pattern or a separate reflective metal pattern. As a further alternative, a semitransmissive and semireflective type that is a combination of the transmissive type and the reflective type is possible.

The operation of the electrooptic device 10 according to this embodiment will be described.

The control circuit 20 reveres the polarity of the polarity indication signal Pol every horizontal scanning period H, as described above. Thus, the polarity indication signal Pol goes to a high level at the start of the period of one frame (denoted at frame n), and reverses the polarity every horizontal scanning period H, and goes to a low level at the start of the following (n+1) frame period, and thereafter reverses the polarity every horizontal scanning period H.

In this embodiment, the control circuit 20 shifts the first capacitance signal Vc1*a* to voltage Vsl to bring the polarity indication signal Pol to a high level, and to voltage Vsh to bring the polarity indication signal Pol to a low level. For the second capacitance signal Vc1*b*, the control circuit 20 shifts it to voltage Vsh to bring the polarity indication signal Pol to a high level, and to voltage Vsl to bring the polarity indication signal Pol to a low level. The control circuit 20 holds the third capacitance signal Vc2 at the same voltage LCcom as that of the common electrode 108.

The voltage Vsh is higher than the voltage Lccom by ΔV, and voltage Vsl is lower than the voltage Lccom by ΔV. Thus, the first capacitance signal Vc1*a* and the second capacitance signal Vc1*b* are switched between voltages Vsl and Vsh that are symmetric about the voltage LCcom exclusively in accordance with the level of the polarity indication signal Pol every horizontal scanning period H.

For frame n, since the first scanning line 112 is first selected by the scanning-line driving circuit 140, the scanning signal Y1 goes to a high level.

When a latch pulse Lp is output at the timing that the scanning signal Y1 goes to a high level, the data-line driving circuit 190 reads the display data Da of the pixels in the first row and the first to $240^{th}$ columns, and since the polarity indication signal Pol is at a high level, the data-line driving circuit 190 converts the voltage of the odd-numbered columns to a voltage corresponding to the display data Da of the read columns and positive polarity (its meaning will be described later), and converts the voltage of the even-numbered columns to a voltage corresponding to the display data Da of the read columns and negative polarity (its meaning will also be described later).

The data-line driving circuit 190 provides the voltage converted for each column to the data lines 114 of the first to 240 columns as data signals X1 to X240.

When the scanning signal Y1 goes to a high level, the TFTs 116 of the pixels from the first row and the first column to the first row and the $240^{th}$ column are turned on, so that the data signals X1 to X240 are applied to the pixel electrodes 118. Therefore, the difference voltage between the data signals X1 to X240 and the voltage Lccom of the common electrode 108 is written to the pixel capacitors 120 from the first row and the first column to the first row and the $240^{th}$ column.

When the scanning signal Y1 goes to a high level, the TFT 55 in the first row is turned on in the capacitor-line driving circuit 150. Thus, the off-voltage Voff of the off-voltage feed line 186 is applied to the gate electrode of the TFTs 53 and 54, so that the TFTs 53 and TFT 54 are turned off. When the scanning signal Y1 goes to a high level, the TFTs 51 and 52 of the first row are turned on.

Therefore, the first capacitor line 131 corresponding to the first row is connected to the first feed line 181 to which the first capacitance signal Vc1*a* is applied, while the second capacitor line 132 corresponding to the first row is connected to the second feed line 182 to which the second capacitance signal Vc1*b* is applied. Thus, the voltage of the first capacitor line 131 corresponding to the first row shifts to the voltage Vsl of the first capacitance signal Vc1*a*, and the voltage of the second capacitor line 132 corresponding to the first row shifts to the voltage Vsh of the second capacitance signal Vc1*b* during the period that the scanning signal Y1 at a high level.

Therefore, to the storage capacitor 130 of the pixels in the odd-numbered columns of the pixels from the first row and the first columns to the first row and the $240^{th}$ column, the difference voltage between the corresponding data signal and the voltage Vsl of the first capacitor line 131 is written, while to the storage capacitor 130 in the odd-numbered columns, the difference voltage between the corresponding data signal and the voltage Vsh of the second capacitor line 132 is written.

Then, the scanning signal Y1 goes to a low level, and the scanning signal Y2 goes to a high level.

In the capacitor-line driving circuit 150, when the scanning signal Y1 goes to a low level, the TFT 55 in the first row is turned off, and as the scanning signal Y2 goes to a high level, the TFT 56 in the first row is turned on. Therefore, the on-voltage Von of the engine-speed sensor 18 is applied to the gate electrode of the TFTs 53 and 54 of the first row, and thus the TFTs 53 and 54 are turned on.

Since the scanning signal Y1 goes to a low level, the TFTs 51 and 52 in the first row are turned off.

Therefore, when the scanning signal Y2 goes to a high level, the first capacitor line 131 and the second capacitor line 132 corresponding to the first row are connected to the third feed line 184 to which the third capacitance signal Vc2 is applied, so that the voltages shifts to voltage Lccom. Thus, the voltage of the first capacitor line 131 rises ΔV from that when the scanning signal Y1 was at a high level, and in contrast, the voltage of the second capacitor line 132 drops by ΔV.

When the scanning signal Y1 goes to a low level, the TFTs 116 of the pixels from the first row and the first column to the first row and the $240^{th}$ column are turned off. Therefore, with the pixel capacitors 120 and the storage capacitors 130 in the first row and the odd-numbered columns connected in series, the first capacitor line 131 which is the second end of the storage capacitor 130 rises by voltage ΔV while the common electrode 108 which is the second end of the pixel capacitor 120 is held constant at voltage Lccom. Thus, the electric charge accumulated in the pixel capacitor 120 and the storage capacitor 130 when the scanning signal Y1 was at a high level is redistributed to change the difference voltage of the pixel capacitor 120.

For the pixels of the even-numbered columns, with the pixel capacitor 120 and the storage capacitor 130 connected in series, the second capacitor line 132 which is the second end of the storage capacitor 130 drops by voltage ΔV while the common electrode 108 which is the second end of the pixel capacitor 120 is held constant at voltage LCcom. Thus, the electric charge accumulated in the pixel capacitor 120 and the storage capacitor 130 when the scanning signal Y1 was at a high level is redistributed to change the difference voltage of the pixel capacitor 120 as in the odd-numbered columns. The changes in the voltages will be described later.

When the latch pulse Lp is output at the timing that the scanning signal Y2 goes to a high level, the data-line driving circuit 190 reads the display data Da of the pixels in the second row and the first to $240^{th}$ columns, and since the polarity indication signal Pol is reversed to a low level, the data-line driving circuit 190 converts the voltage for the odd-numbered columns to a voltage corresponding to the display data Da of the read columns and corresponding to negative polarity, and converts the voltage for the even-numbered columns to a voltage corresponding to the display data Da of the read columns and corresponding to positive polarity, and applies the voltages to the data lines 114 on the first to $240^{th}$ columns as data signals X1 to X240.

When the scanning signal Y2 is at a high level, the TFTs 116 of the pixels from the second row and the first column to the second row and the $240^{th}$ column are turned on. Thus, the difference voltage between the data signals 1 to X240 and voltage LCcom is written to the pixel capacitors 120 from the second row and the first column to the second row and the $240^{th}$ column.

When the polarity indication signal Pol is reversed in polarity during the period that the scanning signal Y2 goes to a low level in frame n, the first capacitance signal Vc1*a* shifts to voltage Vsh, and the second capacitance signal Vc1*b* shifts to voltage Vsl. When the scanning signal Y2 goes to a low level, the TFT 55 of the second row is turned on, and the TFTs 53 and 54 of the second row are turned off in the capacitor-line driving circuit 150. When the scanning signal Y2 goes to a high level, the TFTs 51 and 52 of the second row are turned on. Therefore, the voltage of the first capacitor line 131 corresponding to the second row shifts to the voltage Vsh of the first capacitance signal Vc1*a*, and the voltage of the second capacitor line 132 corresponding to the second row shifts to the voltage Vsl of the second capacitance signal Vc1*b*.

Therefore, to the storage capacitor 130 of the pixels in the odd-numbered columns of the pixels from the second row and the first column to the second row and the $240^{th}$ column, the difference voltage between the corresponding data signal and the voltage Vsh is written, and to the storage capacitor 130 in the odd-numbered columns, the difference voltage between the corresponding data signal and the voltage Vsl is written.

Then, the scanning signal Y2 goes to a low level, and the scanning signal Y3 goes to a high level.

In the capacitor-line driving circuit 150, since the scanning signal Y2 goes to a low level, the TFT 56 in the first row is turned off. Therefore, the gate electrode of the TFTs 53 and 54 corresponding to the first row is disconnected from any part into high impedance but is held by its parasitic capacitance at on-voltage Von just before the TFT 56 is turned off. Therefore, the TFTs 53 and 54 of the first row are held at ON state, so that the first capacitor line 131 and the second capacitor line 132 of the first row are held at the voltage Lccom of the third capacitance signal Vc2.

Accordingly, the pixel capacitors 120 of the first row are fixed at the voltage changed when the scanning signal Y2 went to a high level.

The second row of the capacitor-line driving circuit 150 will be described. Since the scanning signal Y2 goes to a low level, the TFT 55 in the second row is turned off, and since the scanning signal Y3 goes to a high level, the TFT 56 in the second row is turned on. Therefore, the TFTs 53 and 56 of the second row are turned on, while the TFTs 51 and 52 of the first row are turned off since the scanning signal Y1 goes to a low level. Accordingly, when the scanning signal Y3 goes to a high level, the first capacitor line 131 and the second capacitor line 132 corresponding to the second row are connected to the third feed line 184. Thus, the voltage of the first capacitor line 131 and the second capacitor line 132 shifts to voltage Lccom. That is, the first capacitor line 131 drops in voltage by ΔV and the second capacitor line 132 rises in voltage by ΔV from that when the scanning signal Y2 was at a high level. Accordingly, when the scanning signal Y3 goes to a high level in frame n, with the pixel capacitor 120 and the storage capacitor 130 in the second row and the odd-numbered columns connected in series, the second end of the storage capacitor 130 drops in voltage by ΔV, while the second end of the pixel capacitor 120 is held constant at voltage LCcom. Therefore, the electric charge accumulated in the pixel capacitor 120 and the storage capacitor 130 when the scanning signal Y2 was at a high level is redistributed to change the difference voltage of the pixel capacitor 120.

In the pixels of the even-numbered columns, with the pixel capacitor 120 and the storage capacitor 130 connected in series, the second end of the storage capacitor 130 rises in voltage by ΔV, while the second end of the pixel capacitor 120 is held constant at voltage Lccom, thus changing the difference voltage of the pixel capacitor 120 as in the above.

When the scanning signal Y3 goes to a high level, the voltage writing operation similar to that when the scanning signal Y1 was at a high level is executed for the pixel capacitor 120 and the storage capacitor 130 from the third row and the first column to the third row and the $240^{th}$ column.

Then, the scanning signal Y3 goes to a low level, and the scanning signal Y4 goes to a high level.

In the capacitor-line driving circuit 150, since the scanning signal Y3 goes to a low level, the TFT 56 in the second row is turned off, and thus, the gate electrode of the TFTs 53 and 54 corresponding to the second row goes into high impedance but is held at on-voltage Von by its parasitic capacitance. Therefore, the TFTs 53 and 54 of the second row are held at ON state, so that the first capacitor line 131 and the second capacitor line 132 of the second row are held at the voltage Lccom of the third capacitance signal Vc2. Accordingly, the pixel capacitors 120 in the second row are fixed at the voltage changed when the scanning signal Y3 went to a high level.

When the scanning signal Y4 goes to a high level, the voltage writing operation similar to that when the scanning signal Y2 was at a high level is executed for the pixel capacitor 120 and the storage capacitor 130 from the fourth row and the first column to the fourth row and the $240^{th}$ column.

The same operation is repeated in frame n.

Specifically, when a scanning line of an odd-numbered row is selected in frame n and the scanning signal to the scanning line goes to a high level, the difference voltage written to the pixel capacitor 120 and the storage capacitor 130 changes in the pixels of the preceding even-numbered row (the direction of the change is opposite between the odd-numbered columns and the even-numbered columns). In the pixels of the odd-numbered rows and the odd-numbered columns, the difference voltage between the voltage of the data signal corresponding to the display data Da and voltage LCcom is written to the pixel capacitor 120, and the difference voltage between the voltage of the data signal and the voltage Vsl of the first capacitor line 131 is written; and for the pixels in the odd-numbered rows and the even-numbered columns, the difference voltage between the voltage of the data signal corresponding to the display data Da and the voltage LCcom is written to the pixel capacitor 120 and the difference voltage between the voltage of the data signal and the voltage Vsh of the second capacitor line 132 is written.

When a scanning line of an even-numbered row is selected in frame n, and the scanning signal to the scanning line goes to a high level, the difference voltage written to the pixel capacitor 120 and the storage capacitor 130 changes in the pixels of the preceding odd-numbered row (the direction of the change is opposite between the odd-numbered columns and the even-numbered columns). In the pixels of the even-numbered rows and the odd-numbered columns, the difference voltage between the voltage of the data signal corresponding to the display data Da and voltage LCcom is written to the pixel capacitor 120, and the difference voltage between the voltage of the data signal and the voltage Vsh of the first capacitor line 131 is written; and for the pixels of the even-numbered rows and the even-numbered columns, the difference voltage between the voltage of the data signal corresponding to the display data Da and the voltage LCcom is written to the pixel capacitor 120 and the difference voltage between the voltage of the data signal and the voltage Vsl of the second capacitor line 132 is written.

Since no pixel is present in the $321^{st}$ scanning line 112, when the scanning signal Y321 goes to a high level, only the operation of turning on the TFT 56 corresponding to the immediately preceding $320^{th}$ row to fix the first capacitor line 131 and the second capacitor line 132 of the $320^{th}$ row at the voltage Lccom of the third feed line 184 is executed.

In the following frame (n+1), the phase of the polarity indication signal Pol shifts by 180 degrees. Therefore, when the scanning signal to the scanning line of an odd-numbered row goes to a high level, the difference voltage written to the pixel capacitor 120 and the storage capacitor 130 changes in the pixels of the preceding even-numbered row. In the pixels of the odd-numbered rows and the odd-numbered columns, the difference voltage between the voltage of the data signal corresponding to the display data Da and voltage LCcom is written to the pixel capacitor 120, and the difference voltage between the voltage of the data signal and the voltage Vsh of the first capacitor line 131 is written; and for the pixels in the odd-numbered rows and the even-numbered columns, the difference voltage between the voltage of the data signal corresponding to the display data Da and the voltage LCcom is written to the pixel capacitor 120 and the difference voltage between the voltage of the data signal and the voltage Vsl of the second capacitor line 132 is written.

When the scanning signal to a scanning line of an even-numbered row goes to a high level in frame (n+1), the difference voltage written to the pixel capacitor 120 and the storage capacitor 130 changes in the pixels of the preceding odd-numbered row. In the pixels of the even-numbered rows and the odd-numbered columns, the difference voltage between the voltage of the data signal corresponding to the display data Da and voltage LCcom is written to the pixel capacitor 120, and the difference voltage between the voltage of the data signal and the voltage Vsl of the first capacitor line 131 is written; and for the pixels of the even-numbered rows and the even-numbered columns, the difference voltage between the voltage of the data signal corresponding to the display data Da and the voltage LCcom is written to the pixel capacitor 120 and the difference voltage between the voltage of the data signal and the voltage Vsh of the second capacitor line 132 is written.

Changes in the difference voltage of the pixel capacitor 120 through redistribution of the electric charges accumulated in the pixel capacitor 120 and the storage capacitor 130 by voltage change ΔV of capacitor lines will be described.

FIGS. 7A and 7B show changes in the voltage of the pixel capacitors 120 of the pixel in the odd $i^{th}$ row and the odd $j^{th}$ column and the adjacent pixel in the odd $i^{th}$ row and the even $(j+1)^{th}$ column.

When a scanning signal Yi goes to a high level, TFTs 116 in the $i^{th}$ row and the $j^{th}$ column and in the $i^{th}$ row and the $(j+1)^{th}$ column are turned on as shown in FIG. 7A. Therefore, for the pixel in the $i^{th}$ row and the $j^{th}$ column, a data signal Xj is applied to a first end of the pixel capacitor 120 (the pixel electrode 118) and to one of the storage capacitor 130, and for the pixel in the $i^{th}$ row and the $(j+1)^{th}$ column, a data signal X(j+1) is applied to a first end of the pixel capacitor 120 and to a first end of the storage capacitor 130.

When the scanning signal Yi is at a high level in frame n, the TFTs 51 and 52 corresponding to the $i^{th}$ row is turned on in the capacitor-line driving circuit 150. Therefore, the voltage Ca-i of the first capacitor line 131 of the $i^{th}$ row shifts to voltage Vsl, and the voltage Cb-i of the second capacitor line 132 of the $i^{th}$ row shifts to voltage Vsl, as described above.

Let Va be the voltage of the data signal Xj corresponding to the pixel in the $i^{th}$ row and the $j^{th}$ column, and let Vb be the voltage of the data signal X(j+1) corresponding to the pixel in the $i^{th}$ row and the $(j+1)^{th}$ column. Voltage Va is applied to the first end of the pixel capacitor 120 and the first end of the storage capacitor 130 in the $i^{th}$ row and the $j^{th}$ column during the period that the scanning signal Yi is at a high level, while voltage Vb is applied to the first end of the pixel capacitor 120 and the first end of the storage capacitor 130 in the $i^{th}$ row and the $(j+1)^{th}$ column.

When the scanning signal Yi goes to a low level, the TFTs 116 in the $i^{th}$ row and the $j^{th}$ column and in the $i^{th}$ row and the $(j+1)^{th}$ column are turned off, as shown in FIG. 7B. When the scanning signal Yi goes to a low level, the following scanning signal Y(i+1) goes to a high level (the $(i+1)^{th}$ row is not shown in FIG. 7B). Therefore, the TFTs 51 and 52 are turned off, the TFT 55 is turned off, and the TFT 56 is turned on in the $i^{th}$ row of the capacitor-line driving circuit 150.

Therefore, since the TFTs 53 and 54 of the $i^{th}$ row are turned on, both of the voltages of the first capacitor line 131 of the $i^{th}$ row to which the second end of the storage capacitor 130 of the odd $i^{th}$ column is connected and the second capacitor line 132 of the $i^{th}$ row to which the second end of the storage capacitor 130 of the even $(j+1)^{th}$ column is connected are connected to the third feed line 184 to shift to voltage Lccom. Therefore, the voltage ca-i of the first capacitor line 131 rises by ΔV, and the voltage Cb-i of the second capacitor line 132 drops by ΔV from that when the scanning signal Yi was at a high level. In contrast, the common electrode 108 of this embodiment is constant at voltage Lccom.

Accordingly, the pixel in the $i^{th}$ row and the $i^{th}$ column, with the pixel capacitor 120 and the storage capacitor 130 connected in series, the second end of the storage capacitor 130 rises in voltage by ΔV, with the voltage of the second end (common electrode) of the pixel capacitor 120 held constant. Thus, the electric charge accumulated in the storage capacitor 130 shifts to the pixel capacitor 120, thereby increasing the voltage of the pixel electrode 118.

Therefore, the voltage of the pixel electrode 118 of the pixel in the $i^{th}$ row and the $i^{th}$ column, which is the point of series connection, is expressed by $$Va+\{Cs/(Cs+Cpix)\}\cdot\Delta V,$$

which is increased from the voltage Va of the data signal when the scanning signal Yi was at a high level by the value obtained by multiplying the voltage change ΔV of the first capacitor line 131 of the $i^{th}$ row by the capacitance ratio of the pixel capacitor 120 to the storage capacitor 130 {Cs/(Cs+Cpix)}.

In other words, when the voltage Ca-i of the first capacitor line 131 of the $i^{th}$ row rises by ΔV, the voltage of the pixel electrode 118 rises from the voltage Va of the data signal when the scanning signal Yi was at a high level by {Cs/(Cs+Cpix)}·ΔV (=ΔVpix).

For the pixel in the $i^{th}$ row and the $(j+1)^{th}$ column, with the pixel capacitor 120 and the storage capacitor 130 connected in series, the second end of the storage capacitor 130 drops in voltage by ΔV, with the voltage of the second end (common electrode) of the pixel capacitor 120 held constant. Thus, the electric charge accumulated in the pixel capacitor 120 shifts to the storage capacitor 130, thereby decreasing the voltage of the pixel electrode 118.

Therefore, the voltage of the pixel electrode 118 of the pixel in the $i^{th}$ row and the $(j+1)^{th}$ column, which is the point of series connection, is expressed by $$Vb-\{Cs/(Cs+Cpix)\}\cdot\Delta V,$$

which is decreased from the voltage Vb of the data signal when the scanning signal Yi was at a high level by the value obtained by multiplying the voltage change ΔV of the second capacitor line 132 of the $i^{th}$ row by the capacitance ratio of the pixel capacitor 120 to the storage capacitor 130 {Cs/(Cs+Cpix)}. Here, the parasitic capacitances of the components are ignored in both cases.

Figure 5:
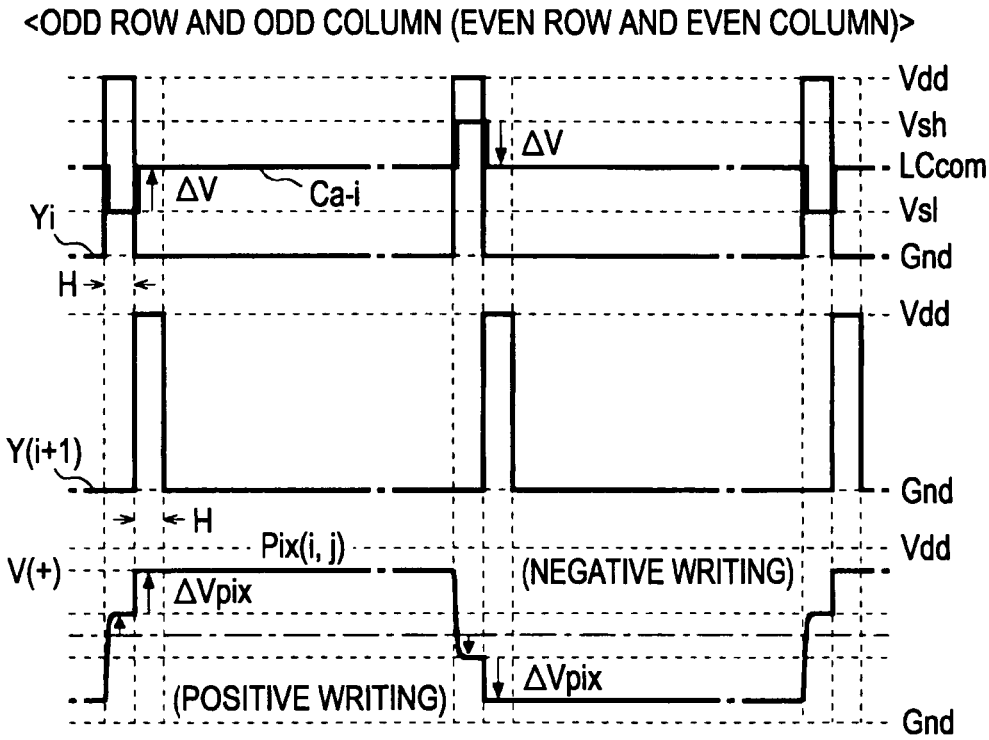
FIG. 5 is a voltage waveform chart for illustrating the operation of the electrooptic device.

In frame n, when the polarity indication signal Pol goes to a high level, and indicates positive writing to the pixels in the odd lines and the odd-numbered columns, the voltage Va of the data signal Xj is set so that the voltage of the pixel electrode 118 increased by ΔVpix after application of the voltage Va shifts to voltage V(+) that is hither than the voltage Lccom of the common electrode 108 by the voltage corresponding to the gray level of the $i^{th}$ row and the $i^{th}$ column (see FIG. 5).

Specifically, in this embodiment which is set in a normally white mode, as shown in FIG. 8A, to provide the pixel in the $i^{th}$ row and the $i^{th}$ column with a gray level between white w and black b for positive writing, the voltage of the pixel electrode 118 corresponding to the gray level when increased by ΔVpix may be set in the range A from voltage Vw(+) corresponding white w to voltage Vb(+) corresponding to black b and increasing with respect to LCcom as the gray level decreases (becomes dark). Therefore, the voltage Va of the data signal Xj is set lower than the voltage corresponding to the gray level by ΔVpix.

Figure 6:
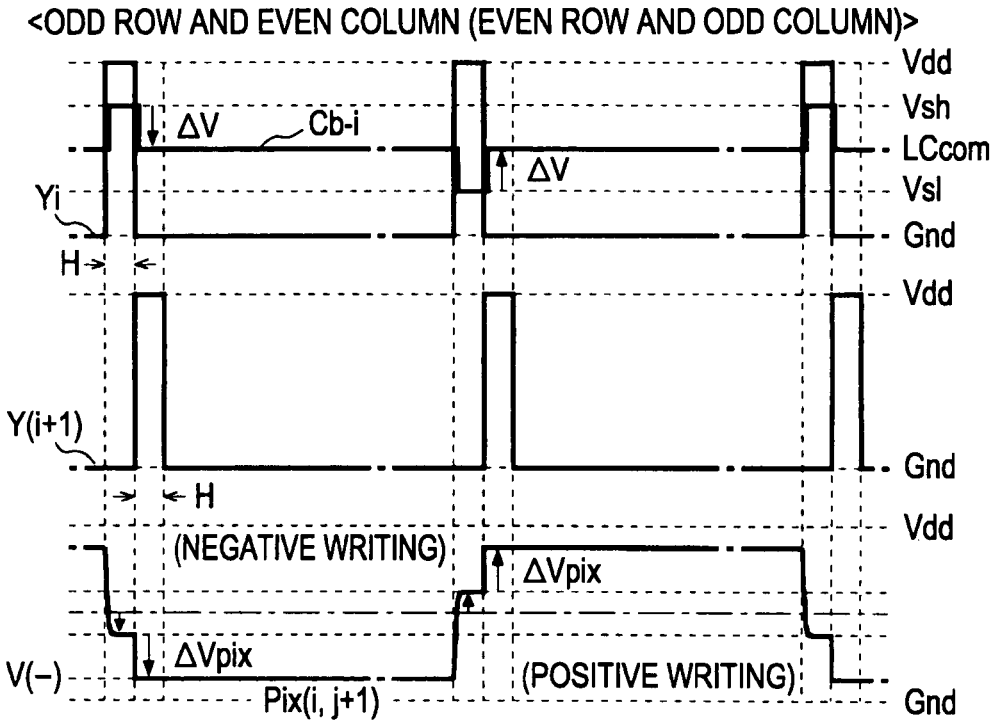
FIG. 6 is a voltage waveform chart for illustrating the operation of the electrooptic device.

When negative writing is designated to the pixels in the odd lines and the even-numbered columns, the voltage Vb of the data signal X(j+1) is set so that the voltage of the pixel electrode 118 decreased by ΔVpix after application of the voltage shifts to voltage V(−) that is lower than the voltage Lccom of the common electrode 108 by the voltage corresponding to the gray level of the $i^{th}$ row and the $j^{th}$ column (see FIG. 6).

Specifically, as shown in FIG. 8B, the voltage of the pixel electrode 118 corresponding to the gray level when decreased by ΔVpix may be set in the range C from voltage Vw(−) corresponding white w to voltage Vb(−) corresponding to black b and decreasing with respect to LCcom as the gray level decreases (becomes dark). Therefore, the voltage. Vb of the data signal X(j+1) is set higher than the voltage corresponding to the gray level by ΔVpix.

At that time, equating the ranges of the voltages for positive writing and negative writing will minimize the amplitude range of the data signals.

Specifically, it is preferable to set the center of the amplitude B of the data signal for positive writing in FIG. 8A and the center of the amplitude D of the data signal for negative writing in FIG. 8B so as to agree at voltage Lccom, and, when the data signal rises by ΔVpix, to set voltage ΔV (=Vsh−

Lccom=Lccom−Vsl) so that, when the data signal rises by ΔVpix, the amplitude shifts to the range A from the voltage Vw(+) to Vb(+), and when the data signal drops by ΔVpix, the amplitude shift to the range C from the voltage Vw(−) to Vb(−).

In FIG. 8A, the amplitude B of the data signal for positive writing is low at white W and high at black b, while in FIG. 8B, the amplitude D of the data signal for negative writing is high at white W and low at black b, whose gray levels are reversed.

While FIGS. 7A and 7B illustrate positive writing by the rise ΔV of the first capacitor line 131 of the pixel in the odd-numbered $i^{th}$ row and the odd-numbered $j^{th}$ column in frame n, and negative writing by the drop ΔV of the second capacitor line 132 of the pixel in the odd-numbered $i^{th}$ row and the even $(j+1)^{th}$ column in frame n. For the following even-numbered (i+1) row, negative writing by the drop ΔV of the first capacitor line 131 is executed for the pixel in the odd-numbered $j^{th}$ column, and positive writing by the rise ΔV of the second capacitor line 132 is executed for the pixel in the even-numbered $(j+1)^{th}$ column.

In the following frame (n+1), for the odd-numbered $i^{th}$ row, negative writing by the drop ΔV of the first capacitor line 131 is executed for the odd-numbered $j^{th}$ column, and positive writing by the rise ΔV of the second capacitor line 132 is executed for the pixel in the even-numbered $(j+1)^{th}$ column. For the odd-numbered (i+1) row, positive writing by the rise ΔV of the first capacitor line 131 is executed for the pixel in the odd-numbered $j^{th}$ column, and negative writing by the drop ΔV of the second capacitor line 132 is executed for the pixel in the even-numbered $(j+1)^{th}$ column.

FIG. 5 shows the change of the voltage ΔVpix(i, j) of the pixel electrode 118 in the $i^{th}$ row and the $j^{th}$ column in relation to the scanning signals Yi and Y(i+1) and the voltage Ca-i of the first capacitor line 131 of the $i^{th}$ row, representing the pixels in the odd-numbered rows and the odd-numbered columns. As shown in the drawing, for the pixels in the odd-numbered rows and the odd-numbered columns, positive writing by the rise of the voltage of the first capacitor line 131 and negative writing by the drop of the voltage of the first capacitor line 131 are executed every one frame. This also applies to the pixels in the even-numbered rows and the even-numbered columns.

FIG. 6 shows the change of the voltage ΔVpix(i, j+1) of the pixel electrode 118 in the $i^{th}$ row and the $(j+1)^{th}$ column in relation to the scanning signals Yi and Y(i+1) and the voltage Cb-i of the second capacitor line 132 of the $i^{th}$ row, representing the pixels in the odd-numbered rows and the even-numbered columns. As shown in the drawing, for the pixels in the odd-numbered rows and the even-numbered columns, negative writing by the drop of the voltage of the second capacitor line 132 and positive writing by the rise of the voltage of the second capacitor line 132 are executed every one frame. This also applies to the pixels in the even-numbered rows and the odd-numbered columns.

Thus, this embodiment adopts dot reversing in which the written polarity of pixels is reversed alternately every row and column, thus allowing high contrast ratio and high definition display with reduced flicker.

In this embodiment, the voltage range B of data signals for positive writing agrees with the voltage range D of the data signals for negative writing. Thus, according to this embodiment, the voltage range can be reduced by one-half of the voltage range J when voltage corresponding to the gray level is applied directly. This allows the components of the data-line driving circuit 190 not to have high resistance to voltage and decreases the voltage amplitude of the data lines 114 having parasitic capacitance, thus eliminating the waste of power by the parasitic capacitance.

Specifically, when the pixel capacitor 120 is driven by alternating current in a structure in which the common electrode 108 is held at voltage LCcom and the voltage of one capacitor line provided for each row is held constant, for positive writing, a voltage in the range A from positive voltage Vw(+) to Vb(+) must be written to the pixel electrode 118 in accordance with the gray level, and for negative writing, a voltage in the range C from negative voltage Vw(−) to Vb(−) must be written to the pixel electrode 118 in accordance with the gray level. Therefore, with the common electrode 108 held constant in voltage and the capacitor line is held constant in voltage, the resistance to voltage of the components of the data-line driving circuit 190 must be provided for the range J because the voltage of the data signal ranges over the range J. Furthermore, when the voltage of the data lines 114 having parasitic capacitance changes in voltage in the range J, its power is wasted by the parasitic capacitance. This embodiment can eliminate such disadvantages.

Even if the voltage range of the data signal when positive writing is designated and the voltage range of the data signal when negative writing is designated are not agreed, the voltage amplitude of the data signal can be reduced by changes in the voltage of the capacitor lines.

In this embodiment, the first capacitance signal Vc1*a* and the second capacitance signal Vc1*b* are switched between the voltages Lsh and Vsl every horizontal scanning period H, which are exclusive (complementary) to each other. Thus, the power wasted by the parasitic capacitance of the first feed line 181 and the second feed line 182 can be reduced.

In this embodiment, the second capacitance signal Vc2*a* and the third capacitance signal Vc2*b* are switched between the voltages LCcom and Vsl every horizontal scanning period H, which are exclusive (complementary) to each other. Thus, the power wasted by the parasitic capacitance of the second feed line 182 and the third feed line 183 can be reduced.

This embodiment has a structure in which, in each row of the capacitor-line driving circuit 150, the source electrode of the TFT 52 is connected to the first feed line 181, and the source electrode of the TFT52 are connected to the second capacitor line 132. Instead, the source electrode of the TFT 51 may be connected to the second feed line 182, and the source electrode of the TFT 52 may be connected to the first feed line 181.

Figure 9:
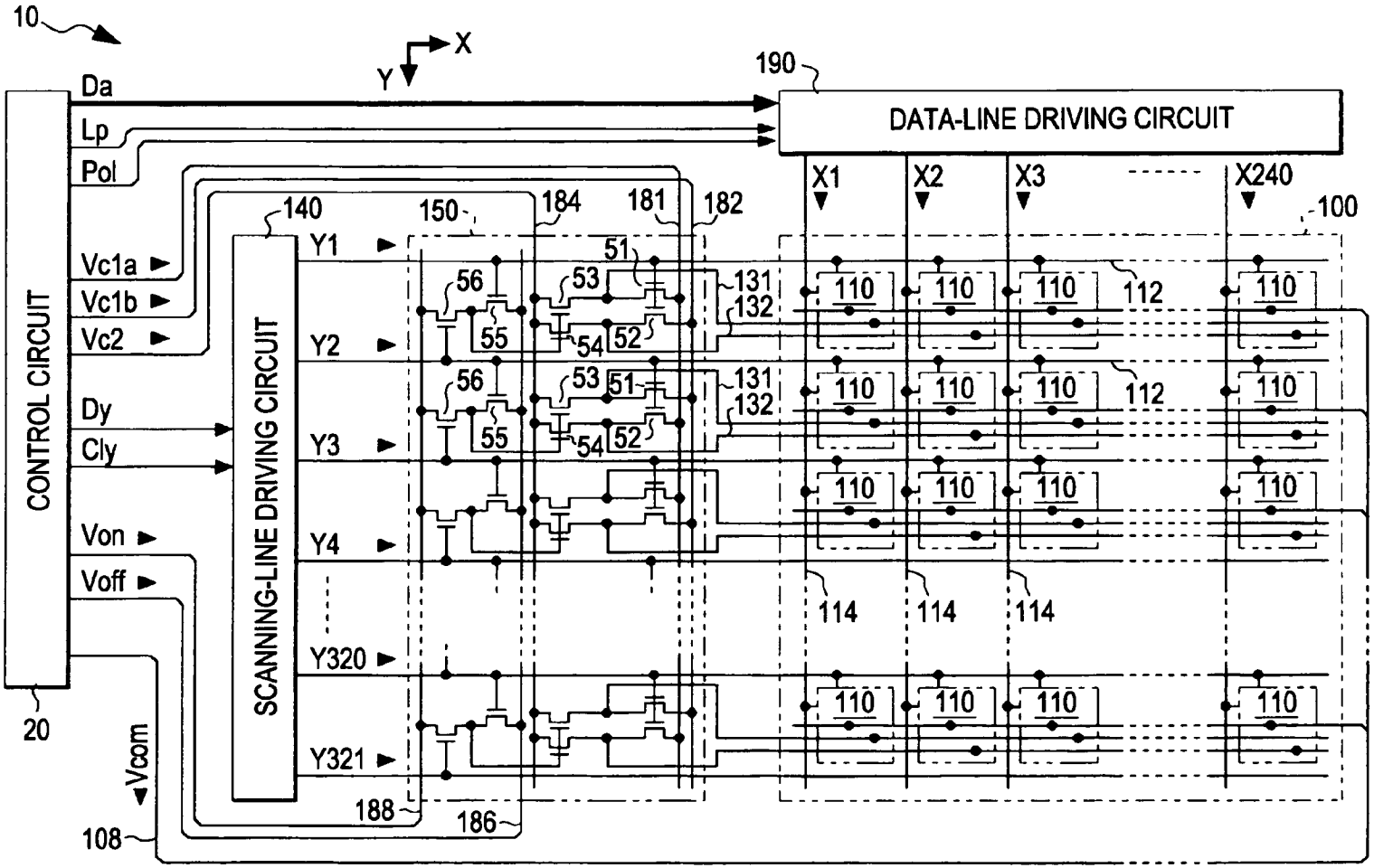
FIG. 9 is a diagram showing a first modification of the electrooptic device according to the first embodiment.
Figure 10:
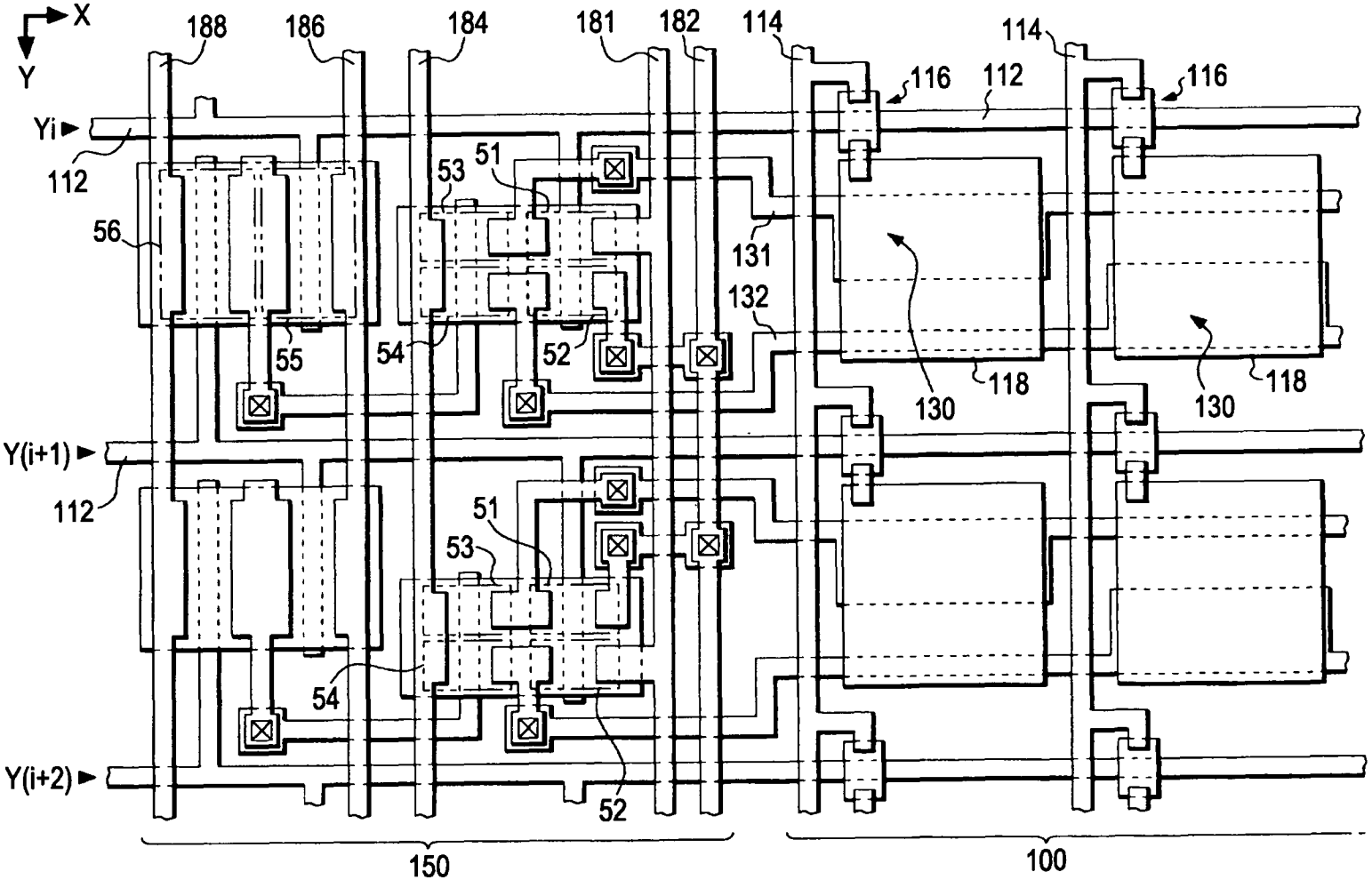
FIG. 10 is a diagram showing the configuration of the boundary between the display region and the capacitor-line driving circuit of the first modification.

In the structure in which the lines to which the source electrodes of the TFTs 51 and 52 are replaced, for the odd-numbered rows, the source electrode of the TFT 51 may be connected to the first feed line 181, and the source electrode of the TFT 52 may be connected to the second feed line 182, and for the even-numbered rows, the source electrode of the TFT 51 may be connected to the second feed line 182, and the source electrode of the TFT 52 may be connected to the first feed line 181, that is, line-by-line alternate connection may be possible, as shown in FIG. 9. FIG. 10 is a plan view of the boundary between the capacitor-line driving circuit 150 and the display region 100 of the device substrate of FIG. 9. A further description is omitted here since the configuration is the same as that of FIG. 3.

Figure 11:
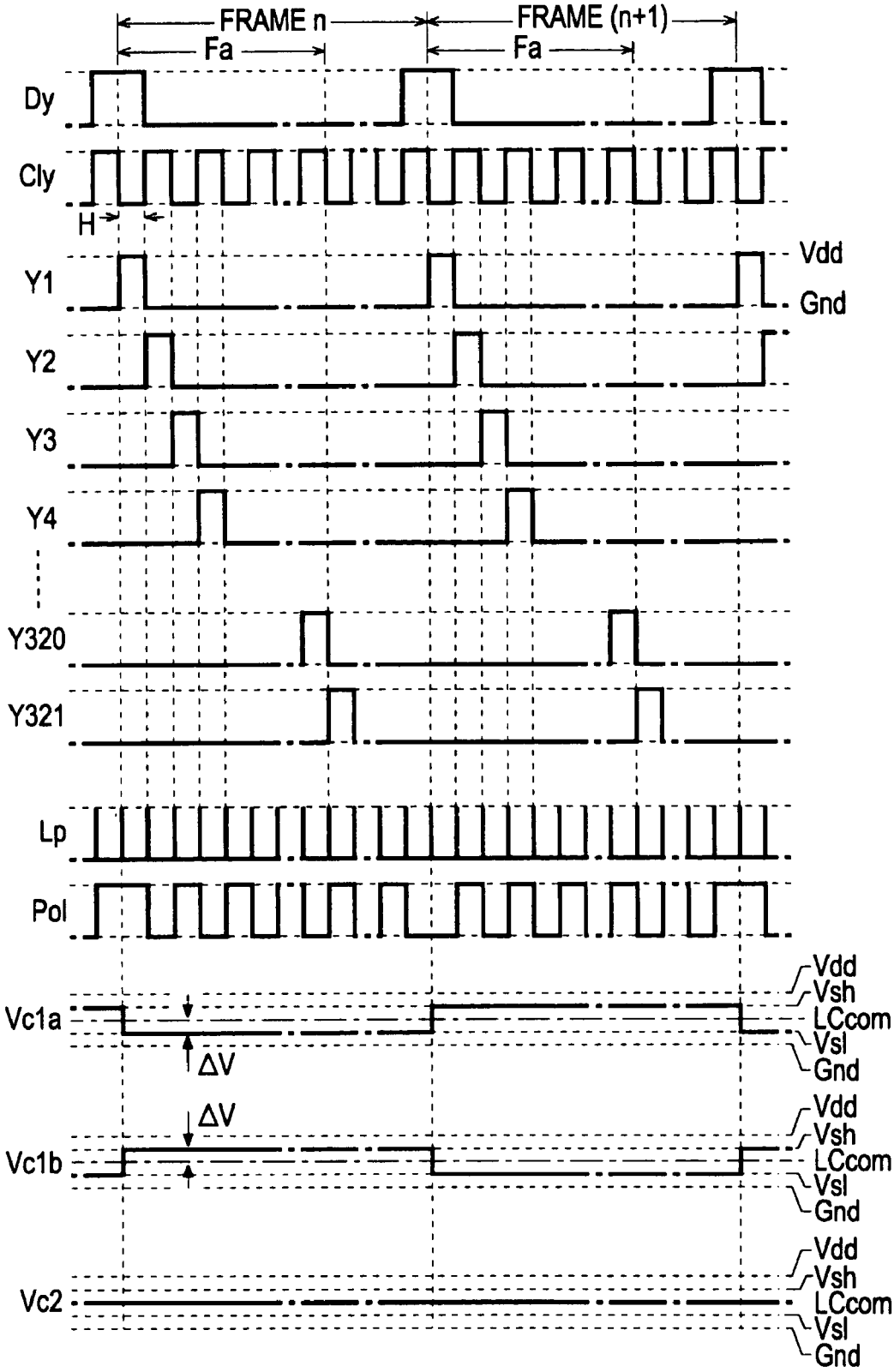
FIG. 11 is a diagram for illustrating the operation of the first modification.

With such a configuration, as shown in FIG. 11, the control circuit 20 the first capacitance signal Vc1*a* to voltage Vsl and the second capacitance signal Vc1*b* to voltage Vsh over frame n, and shifts the first capacitance signal Vc1*a* to voltage Vsh and the second capacitance signal Vc1*b* to voltage Vsl.

With this configuration, the pixel electrodes of the odd-numbered rows and the odd-numbered columns (and the even-numbered rows and the even-numbered columns)

change in voltage, as shown in FIG. 5, and the pixel electrodes of the odd-numbered rows and the even-numbered columns (and the even-numbered rows and the odd-numbered columns) change in voltage, as shown in FIG. 6. Thus, this configuration also adopts dot reversing for polarity writing.

In addition, in this configuration, the first capacitance signal Vc1*a* and the second capacitance signal Vc1*b* are switched not every horizontal scanning period H but every period of one frame. Thus, the power wasted by the switching of voltage can be reduced.

Figure 12:
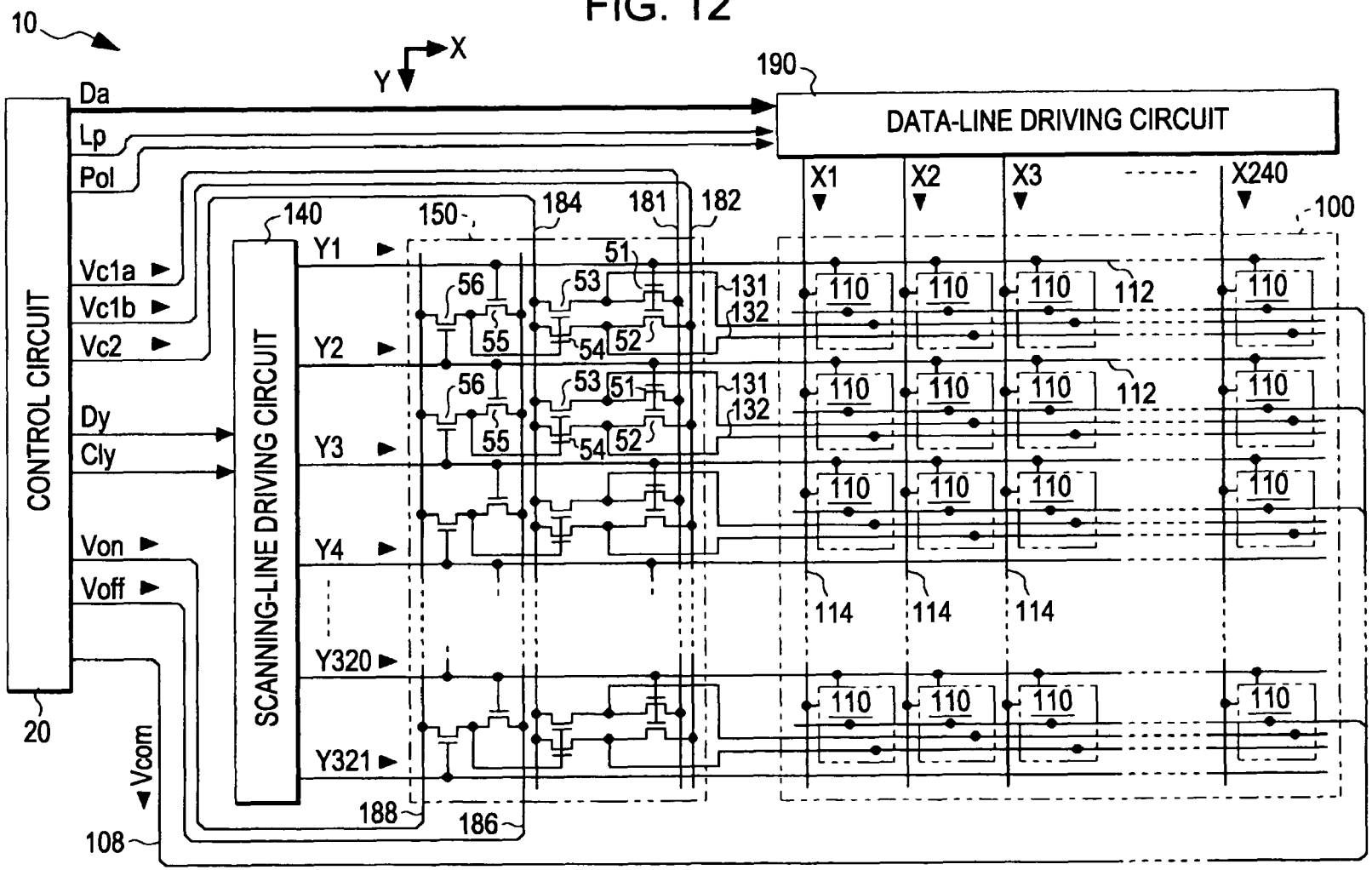
FIG. 12 is a diagram showing a second modification of the electrooptic device according to the first embodiment.

The lines to which the source electrodes of the TFTs 51 and 52 are to be connected may not be switched alternately; instead, the line to which the second end of the storage capacitor 130 may be switched as shown by the dots in the pixels 110 in FIG. 12, and the first capacitance signal Vc1*a* and the second capacitance signal Vc1*b* may have the waveforms shown in FIG. 11. In the configuration shown in FIG. 12, the capacitor-line driving circuit 150 is the same as that of FIG. 1, but the second ends of the storage capacitors 130 in the odd-numbered rows and the odd-numbered columns and in the even-numbered rows and the even-numbered columns are connected to the first capacitor line 131, and the second ends of the storage capacitor 130 in the odd-numbered rows and the even-numbered columns and in the even-numbered rows and the odd-numbered columns are connected to the second capacitor line 132.

With this structure, dot reversing for polarity writing to pixels can be adopted while reducing the power consumed by the switching of the voltages of the first capacitance signal Vc1*a* and the second capacitance signal Vc1*b*.

Figure 13:
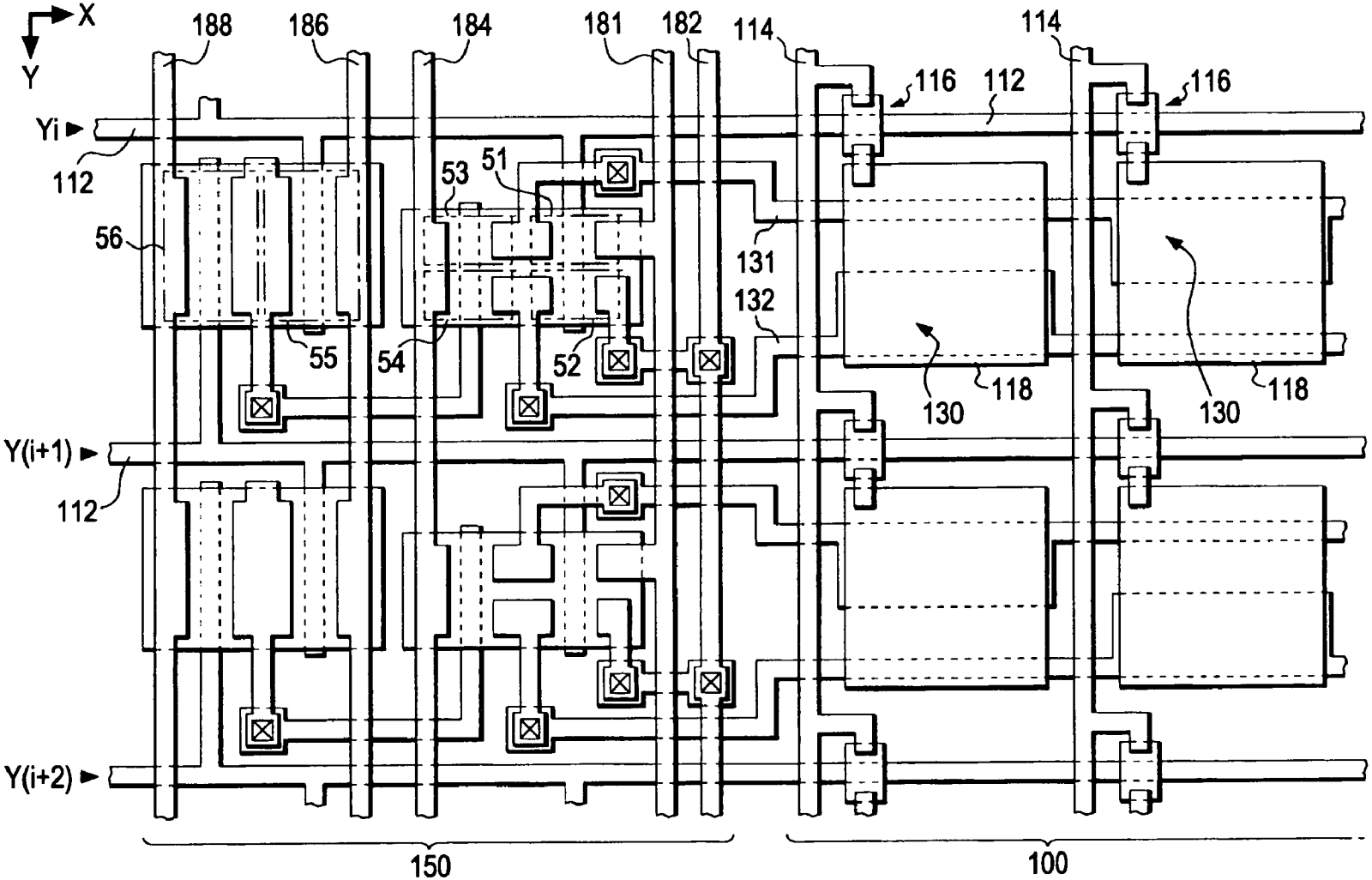
FIG. 13 is a diagram showing the configuration of the boundary between the display region and the capacitor-line driving circuit of the second modification.

FIG. 13 is a plan view of the boundary between the capacitor-line driving circuit 150 and the display region 100 of the device substrate of FIG. 12. A further description is omitted here since the configuration is the same as that of FIG. 3.

Referring back to FIG. 4, in the period from the completion of the selection of the $321^{st}$ scanning line 112 to the start of the selection of the first scanning line 112, the first capacitance signal Vc1*a* of the first feed line 181 and the second capacitance signal Vc1*b* of the second feed line 182 may be held constant in voltage.

Second Embodiment

Figure 14:
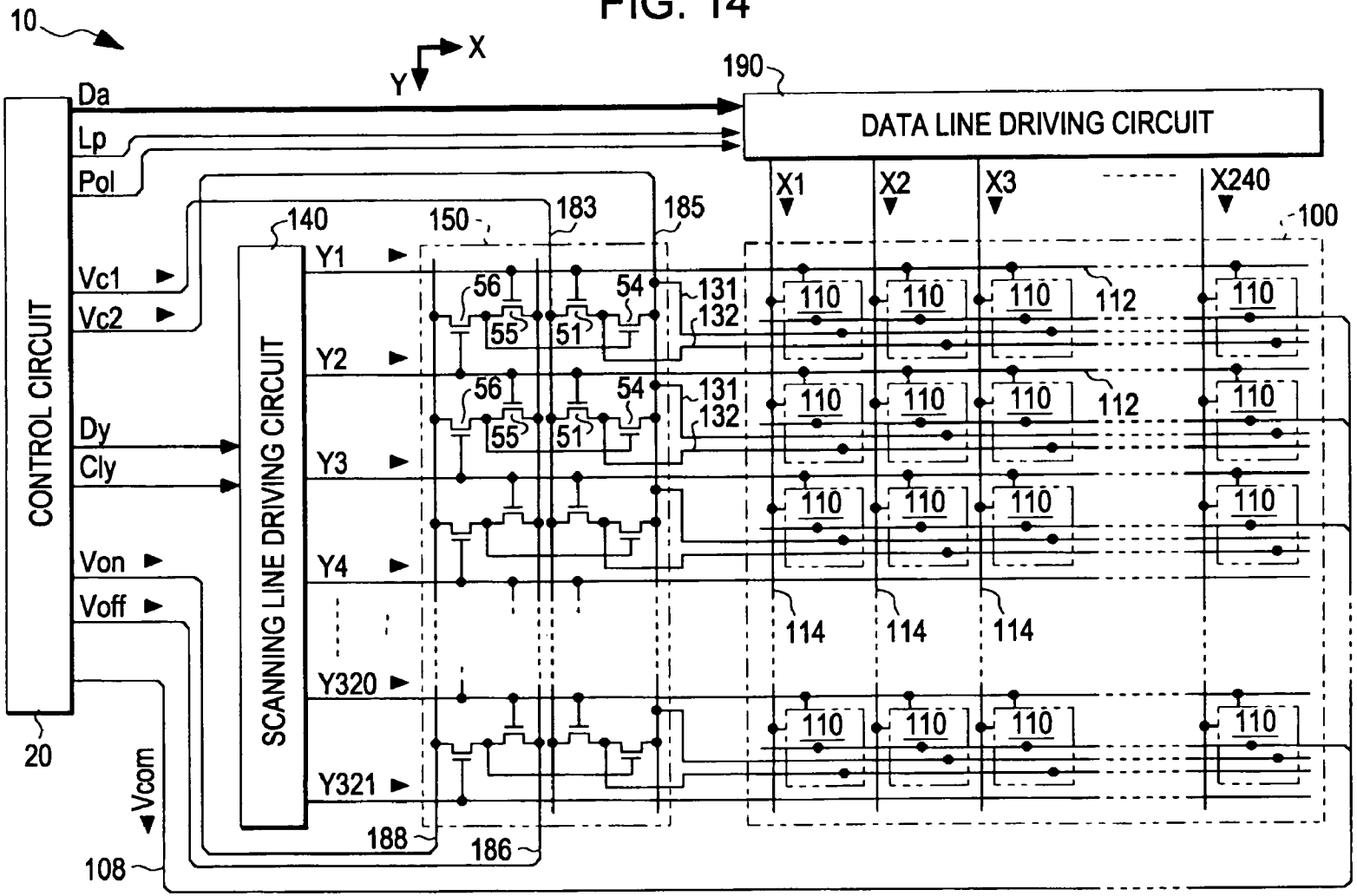
FIG. 14 is a block diagram showing the configuration of an electrooptic device according to a second embodiment of the invention.
Figure 15:
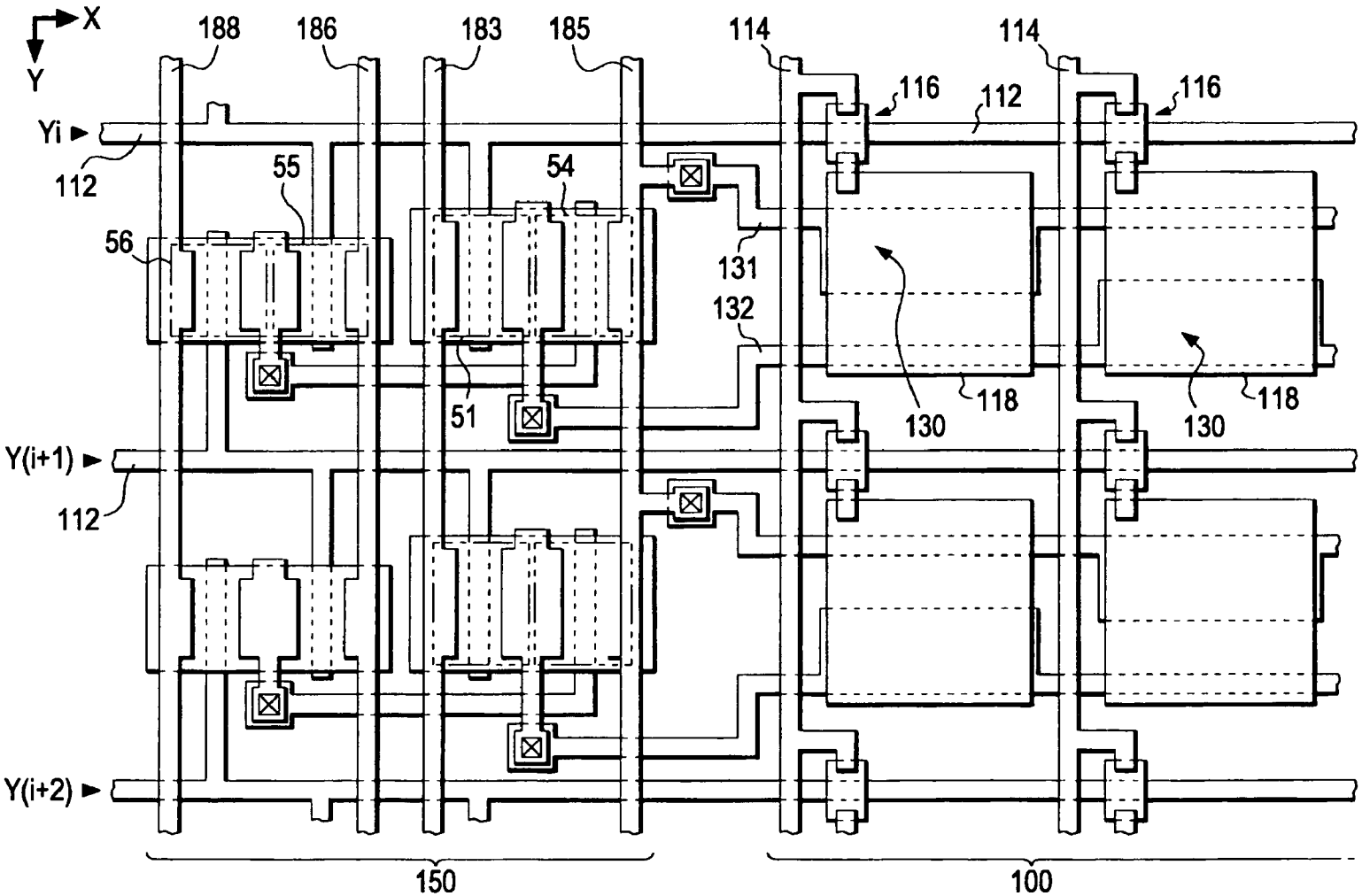
FIG. 15 is a diagram showing the configuration of the boundary between the display region and the capacitor-line driving circuit of the second embodiment.

A second embodiment of the invention will be described. FIG. 14 is a block diagram of an electrooptic device according to the second embodiment; and FIG. 15 is a plan view of the boundary between the capacitor-line driving circuit 150 and the display region 100 of the device substrate.

The second embodiment is different from the first embodiment shown in FIG. 1 (FIG. 3) in the following points: the configuration of the capacitor-line driving circuit 150 (a first difference); there is no third feed line (a second difference); the relationship between the line to which the second end of the storage capacitor 130 is connected and the capacitor line (a third difference); and the common signal Vcom applied to the common electrode 108 is not constant in voltage (a fourth difference).

The second embodiment will be described centering on these differences.

The first and second differences will first be described. The capacitor-line driving circuit 150 of the second embodiment has not the TFTs 52 and 53 but has a set of TFTs 51, 54, 55, and 56 for each row. The gate electrode of the TFT 51 corresponding to the $i^{th}$ row is connected to the $i^{th}$ scanning line 112, and the source electrode is connected to a first feed line 183. The gate electrode of the TFT 54 corresponding to the $i^{th}$ row is connected to the common drain electrode of the TFTs 55 and 56, and the source electrode is connected to a second feed line 185. The common drain electrode of the TFTs 51 and 55 corresponding to the $i^{th}$ row is connected to the second capacitor line 132 of the $i^{th}$ row. The first capacitor line 131 of the $i^{th}$ row is connected to the second feed line 185 without passing through the TFTs.

The third difference will next be described. In the second embodiment, as indicated by the dots in the pixels 110 in FIG. 14, the second ends of the storage capacitors 130 in the odd-numbered rows and the odd-numbered columns and in the even-numbered rows and the even-numbered columns are connected to the respective first capacitor lines 131, and the second ends of the storage capacitors 130 in the odd-numbered rows and the even-numbered columns and in the even-numbered rows and the odd-numbered columns are connected to the respective second capacitor lines 132, as in the configuration shown in FIG. 12.

Figure 16:
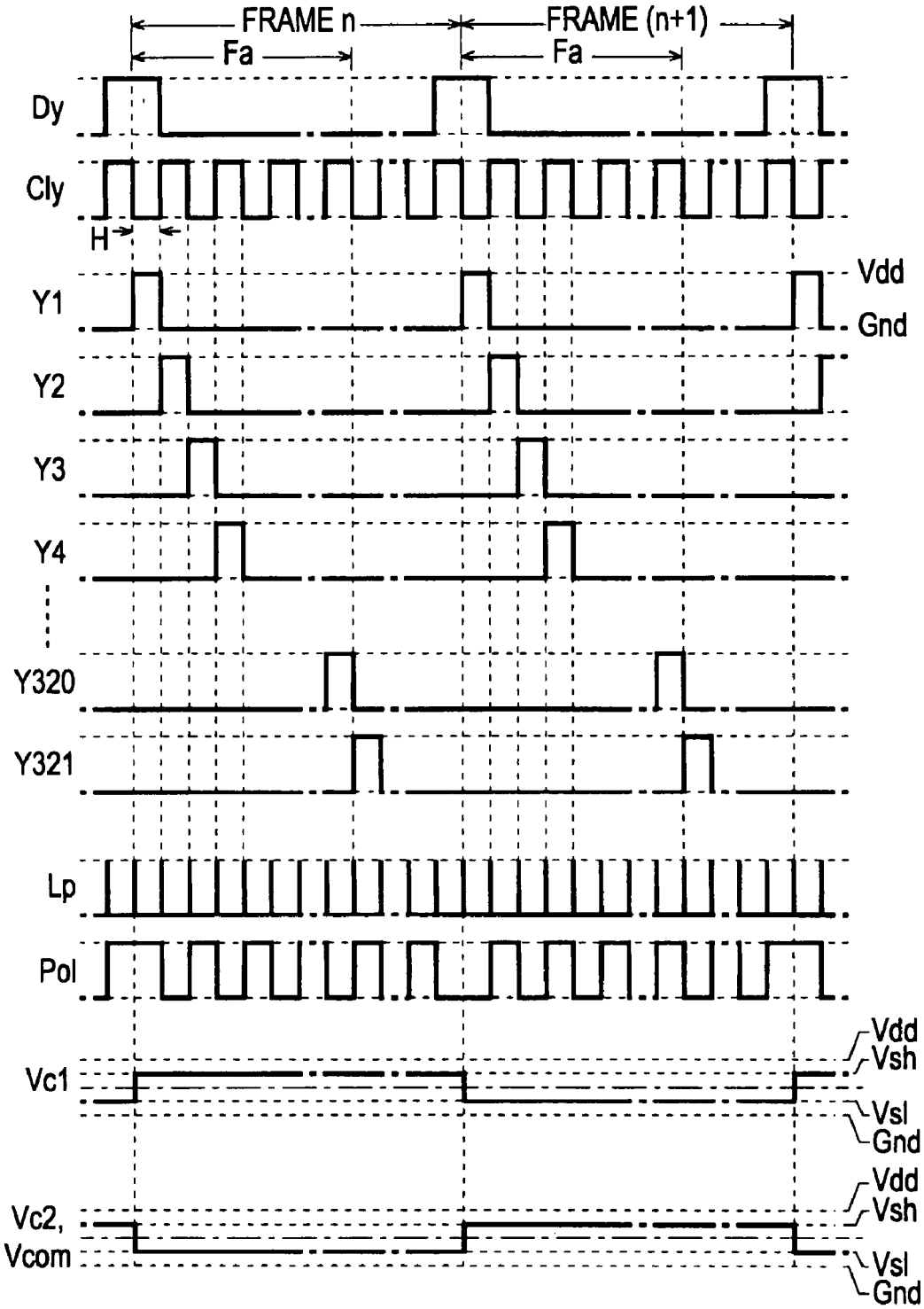
FIG. 16 is a diagram for illustrating the operation of the electrooptic device.

The fourth difference will then be described. In this embodiment, as shown in FIG. 16, the common signal Vcom is shifted to a voltage Vsl over frame n, and to a voltage Vsh over the next frame (n+1), which is switched every period of one frame. The control circuit 20 of the second embodiment applies a first capacitance signal Vc1 to the first feed line 183, and a second capacitance signal Vc2 to the second feed line 185, respectively. As shown in FIG. 16, the first capacitance signal Vc1 are held at voltage Vsh over frame n, and at voltage Vsl over the nest frame (n+1). The second capacitance signal Vc2 of the second embodiment corresponds to the third capacitance signal of the first embodiment and agrees with the common signal Vcom of this embodiment. Accordingly, the first capacitor line 131 connected to the second feed line 185 that feeds the second capacitance signal Vc2 is provided with the common signal Vcom.

The voltages Vsh and Vsl are set at the relation of Vsh−Vsl=ΔV.

The operation of the electrooptic device according to the second embodiment will next be described.

Since the first capacitor lines 131 are connected to the second feed line 185, the first capacitor lines 131 come to have the same waveform as the second capacitance signal Vc2. Therefore, the voltage Ca-i of the first capacitor line 131 of the $i^{th}$ row shifts to voltage Vsl1 in frame n, and shifts to voltage Vsh1 in the next frame (n+1) (see FIGS. 16 and 17).

On the other hand, the second capacitor lines 132 are each connected to the first feed line 183 when the TFT 51 (55) is turned on as the scanning signal to the line corresponding thereto goes to a high level, and when the scanning signal for the line next to the corresponding line goes to a high level, the second capacitor lines 132 are each connected to the second feed line 185 as the TFT 56 (54) is turned on. Thus, in frame n, the voltage Cb-i of the second capacitor line 132 in the $i^{th}$ row shifts to voltage Vsh in the period during which the scanning signal Yi goes to a high level, and shifts to voltage Vsl in the period during which the scanning signal Y(i+1) goes to a high level, decreasing by voltage ΔV. Since the on-state of the TFT 54 is kept even when the scanning signal Y(i+1) goes to a low level, the voltage Cb-i becomes the same voltage as the second capacitance signal Vc2. Thus, the voltage Cb-i shifts to voltage Vsh at the beginning of frame (n+1), shifts to voltage Vsl in the period during which the scanning signal Yi is at a high level, and rises by ΔV to voltage Vsh in the period during which the scanning signal Y(i+1) goes to a high level, and kept at the voltage Vsh until the start of the next frame (see FIGS. 16 and 18).

Figure 17:
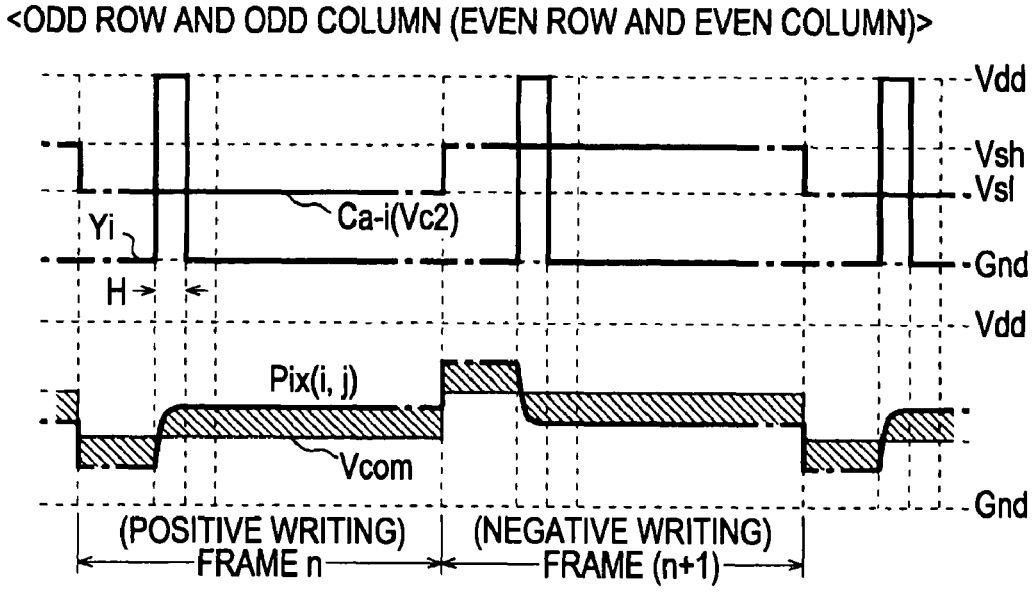
FIG. 17 is a voltage waveform chart for illustrating the operation of the electrooptic device.

In this embodiment, the pixels in which the second ends of the storage capacitors 130 are connected to the first capacitor lines 131 are of the odd-numbered rows and the odd-numbered columns and of the even-numbered rows and the even-numbered columns. Therefore, as shown in FIG. 17, the voltage Ca-i of the first capacitor line 131 of the $i^{th}$ row is switched at th start (end) timing of each frame. The voltage of the common electrode 108 also changes at the same timing. Accordingly, as shown in FIG. 17, when the voltage of the common electrode 108 changes, the voltage Pix(i, j) of the pixel electrode of the odd-numbered $i^{th}$ row and the odd-numbered $j^{th}$ column also changes by the same amount in the same direction at the same time. Therefore, the effective voltages (hatched portions) held in the pixel capacitors 120 are not influenced.

Accordingly, for the pixels in the odd-numbered rows and the odd-numbered columns and in the even-numbered rows and the even-numbered columns in frame n, data signals with a voltage higher than the voltage Vsl of the common signal Vcom by the voltage corresponding to the gray level is written; and for frame (n+1), data signals with a voltage lower than the voltage Vsh of the common signal Vcom by the voltage corresponding to the gray level is written.

On the other hand, the pixels in which the second ends of the storage capacitors 130 are connected to the second capacitor lines 132 are of the odd-numbered rows and the even-numbered columns and of the even-numbered rows and the odd-numbered columns. Therefore, as shown in FIG. 18, the voltage Cb-i of the second capacitor line 132 of the $i^{th}$ row changes by ΔV when the scanning signal Y(i+1) goes to a high level, that is, when the voltage of the data signal is written.

Figure 18:
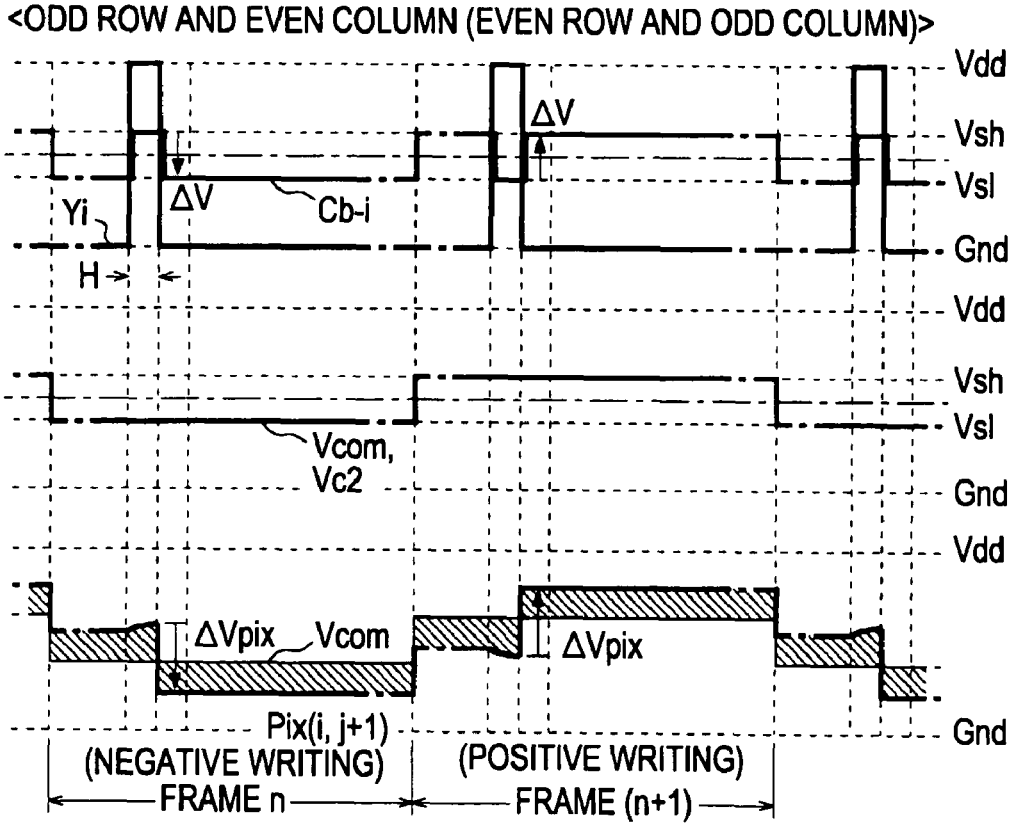
FIG. 18 is a voltage waveform chart for illustrating the operation of the electrooptic device.

As shown in FIG. 18, the voltage Cb-i of the second capacitor line 132 of the $i^{th}$ row changes at the start (end) timing of each frame. The voltage of the common electrode 108 also changes at the same timing. Accordingly, as shown in FIG. 18, when the voltage of the common electrode 108 changes, the voltage Pix(i, j+1) of the pixel electrode of the odd-numbered $i^{th}$ row and the even-numbered $(j+1)^{th}$ column also changes by the same amount in the same direction at the same time. Therefore, the effective voltages (hatched portions) held in the pixel capacitors 120 are not influenced.

Accordingly, for the pixels in the odd-numbered row and the even-numbered columns and in the even-numbered rows and the odd-numbered columns in frame n, when scanning lines corresponding thereto are selected, data signals of a voltage that is set in anticipation of a voltage drop ΔVpix of the pixel electrodes due to the voltage drop ΔV of the second capacitor lines 132 (i.e., a voltage decreased by ΔVpix becomes lower than the voltage Vsl of the common signal Vcom by a voltage corresponding to the gray level) are written; and for frame (n+1), when scanning lines corresponding thereto are selected, data signals of a voltage that is set in anticipation of an increase ΔVpix of the voltage of the pixel electrodes due to the increase ΔV of the voltage of the second capacitor lines 132 (i.e., a voltage increased by ΔVpix becomes higher than the voltage Vsl of the common signal Vcom by a voltage corresponding to the gray level) are written.

The second embodiment has a structure in which the first capacitor lines 131 are connected to the second feed line 185, and the second capacitor lines 132 are each connected to the common drain electrode of the TFTs 51 and 54 of each row; conversely, the first capacitor lines 131 may be each connected to the common drain electrode of the TFTs 51 and 54, and the second capacitor lines 132 may be connected to the second feed line 185.

Figure 19:
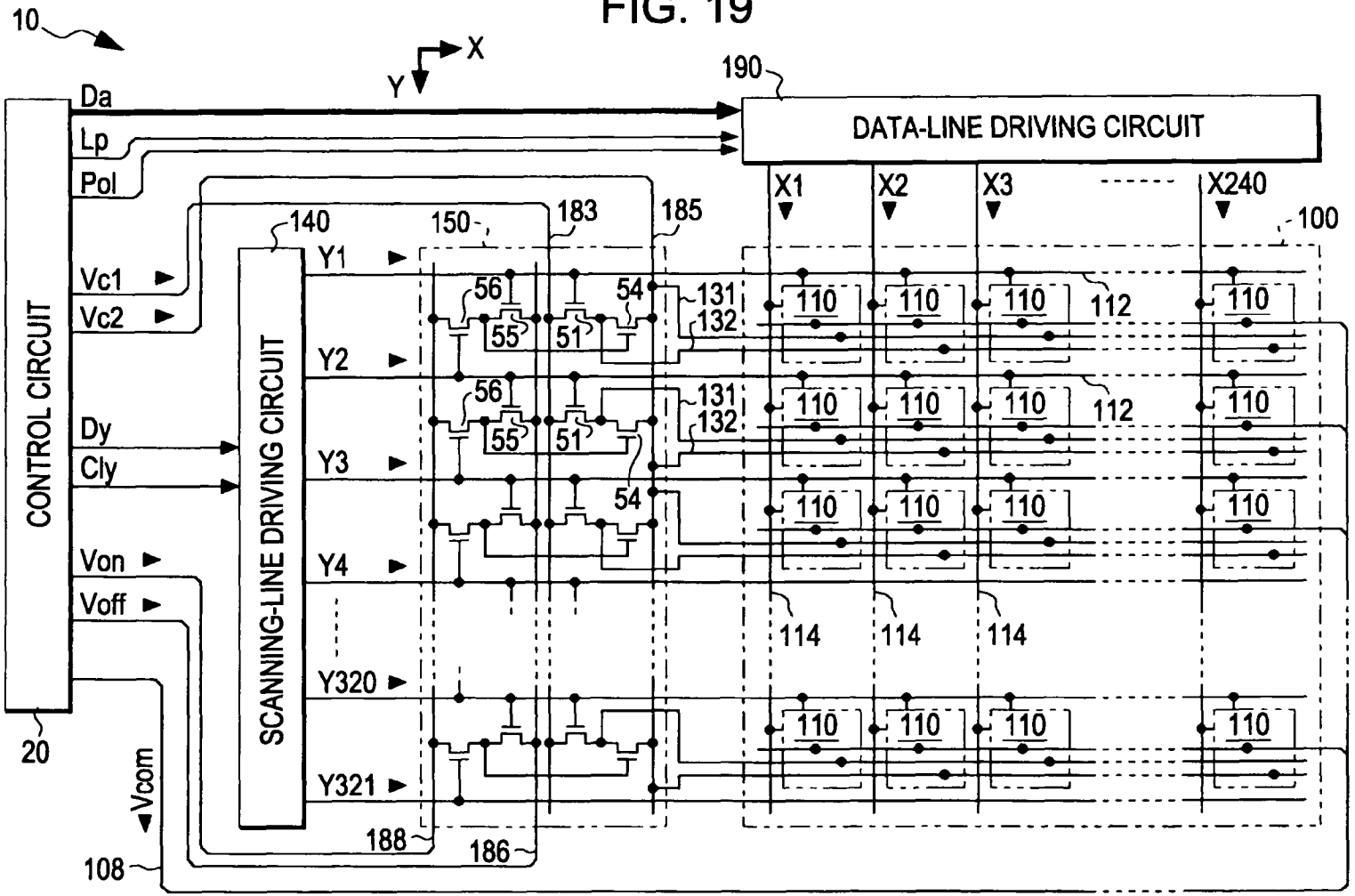
FIG. 19 is a diagram showing a modification of the electrooptic device according to the second embodiment.
Figure 20:
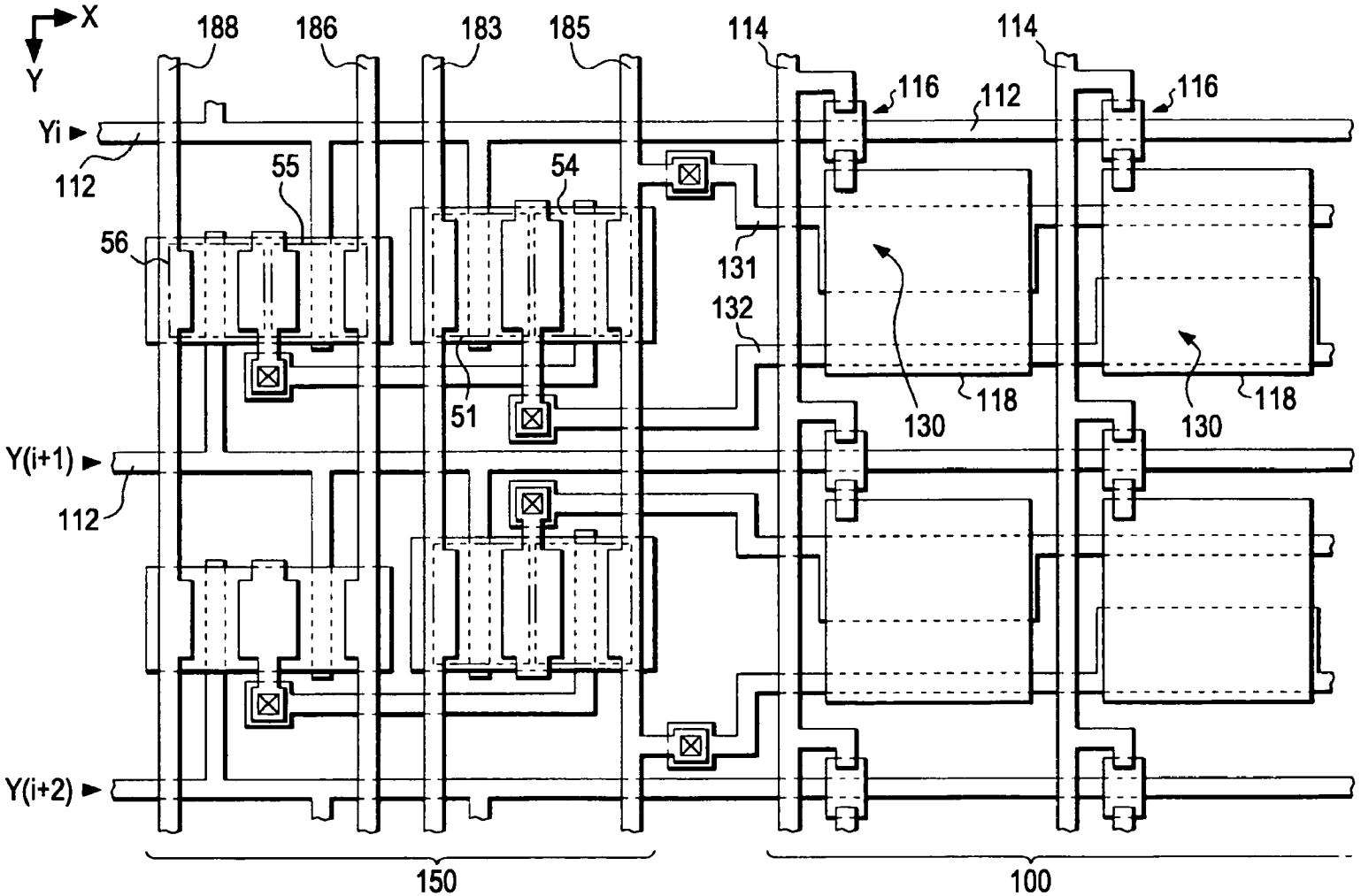
FIG. 20 is a diagram showing the configuration of the boundary between the display region and the capacitor-line driving circuit of the modification.

The second embodiment has a structure in which the first capacitor lines 131 are connected to the second feed line 185, and the second capacitor lines 132 are each connected to the common drain electrode of the TFTs 51 and 54 of each row, and the second ends of the storage capacitors 130 in the odd-numbered rows and the odd-numbered columns and in the even-numbered rows and the even-numbered columns are connected to the first capacitor lines 131, and the second ends of the storage capacitors 130 in the odd-numbered rows and the even-numbered columns and in the even-numbered rows and the odd-numbered columns are connected to the second capacitor lines 132. Alternatively, as shown in FIG. 19, for the odd-numbered rows for example, the first capacitor lines 131 may be connected to the second feed line 185, and the second capacitor lines 132 may be each connected to the common drain electrode of the TFTs 51 and 54; for the even-numbered rows, the first capacitor lines 131 may be each connected to the common drain electrode of the TFTs 51 and 54, and the second capacitor lines 132 may be connected to the second feed line 185; and the second ends of the storage capacitors 130 in the odd-numbered columns of each row may be connected to the first capacitor lines 131, and the second ends of the storage capacitors 130 of the even-numbered columns of each row may be connected to the second capacitor lines 132. FIG. 20 is a plan view of the boundary between the capacitor-line driving circuit 150 and the display region 100 of the device substrate of FIG. 19. A further description is omitted here since the configuration is the same as that of FIG. 3.

Thus, the second embodiment adopts dot reversing in which the written polarity is reversed every row and column, as in the first embodiment. Thus, the embodiment allows high contrast ratio and high definition display with reduced flicker.

The capacitor-line driving circuit 150 of the second embodiment has not the TFTs 52 and 53 of the first embodiment for each row. This simplifies the configuration and reduces the region of the device substrate which does not contribute to display (i.e., the frame), thus reducing the cost.

In the second embodiment, the difference in the amplitudes between the first capacitance signal Vc1 and the second capacitance signal Vc2 is one-half of that of FIG. 11, allowing low power consumption.

In the foregoing embodiments, the gate electrode of the TFT 56 in the $i^{th}$ row of the capacitor-line driving circuit 150 is connected to the next $(i+1)^{th}$ scanning line 112. However, it may be connected to a scanning line 112 apart therefrom by m lines. However, as the number of m increases, the gate electrode of the TFT 56 in the $i^{th}$ row must be connected to a $(i+m)^{th}$ scanning line 112, thus complicating the wiring. Furthermore, this requires m dummy scanning lines 112 to turn on the TFT 56 corresponding to the capacitor line of the last $320^{th}$ row.

If m is 1 as in the foregoing embodiments, the flyback time may be eliminated, and the gate electrode of the TFT 56 of the $320^{th}$ row may be connected to the scanning line 112 of the first row. If m is 2, the flyback time may also be eliminated, and the gate electrode of the TFT 56 corresponding to the $319^{th}$ and the $320^{th}$ rows may be connected to the scanning lines 112 of the first and second rows, respectively. This eliminates the need for the dummy scanning line.

In the foregoing embodiments, since the vertical scanning is executed downward, the gate electrode of the TFT 56 of the $i^{th}$ row are connected to the scanning line 112 of the $(i+1)^{th}$ row. For upward vertical scanning, the gate electrode may be connected to the scanning line 112 of the $(i-1)^{th}$ row. In other words, the gate electrode of the TFT 56 in the $i^{th}$ row may be connected to a scanning line 112 other than the $i^{th}$ scanning line and which is selected in the vertical scanning direction after the $i^{th}$ scanning line is selected.

While the pixel capacitor 120 of the foregoing embodiments has a configuration in which the liquid crystal 105 is sandwiched between the pixel electrode 118 and the common electrode 108, and the electric field applied to the liquid crystal 105 is perpendicular to the substrate surface. Instead, the pixel electrode, the insulating layer, and the common electrode may be disposed in layers and the electric field applied to the liquid crystal may be parallel with the substrate surface.

In the foregoing embodiments, the written polarity is reversed every period of one frame in units of the pixel capacitor 120. This is merely for driving the pixel capacitor 120 with an alternating current. Thus, the polarity may be reversed every two or more frames.

While the pixel capacitor 120 is set in a normally white mode, it may be set in a normally black mode in which pixels become dark under no voltage. Three pixels of red, green, and blue may constitute one dot for color display; four pixels including additional color (e.g., cyan) may constitute one dot to improve the color reproducibility.

In the foregoing description, the polarity writing is based on the voltage of the common electrode 108. This is for the case where the TFTs 116 of the pixels 110 function as ideal switches. However the fact is that the parasitic capacitance between the gate electrode and the drain electrode of the TFT 116 causes a phenomenon (referred to as push-down, punch through, or field through) in which the potential of the drain electrode (the pixel electrode 118) is decreased when the TFT 116 is turned off. The pixel capacitor 120 must be driven by alternating current to prevent degradation of the liquid crystal. However, if the pixel capacitor 120 is driven by alternating current using the voltage applied to the common electrode 108 as the reference of written polarity, the effective voltage of the pixel capacitor 120 by negative writing becomes a little higher than that by positive writing (when the TFT 116 is of an n-channel type. Therefore, in practice, the reference voltage of the polarity writing may be separated from the voltage of the common electrode 108. More specifically, the reference voltage of the polarity writing may be shifted higher than the voltage of the common electrode to offset the influence of the push-down.

Since the storage capacitor 130 is insulated for a direct current, such conditions that the voltage of the first or second capacitor line changes by $\Delta V$ after voltage is written to the pixel capacitor 120 and the storage capacitor 130 may be met.

Electronic Device

Figure 21:
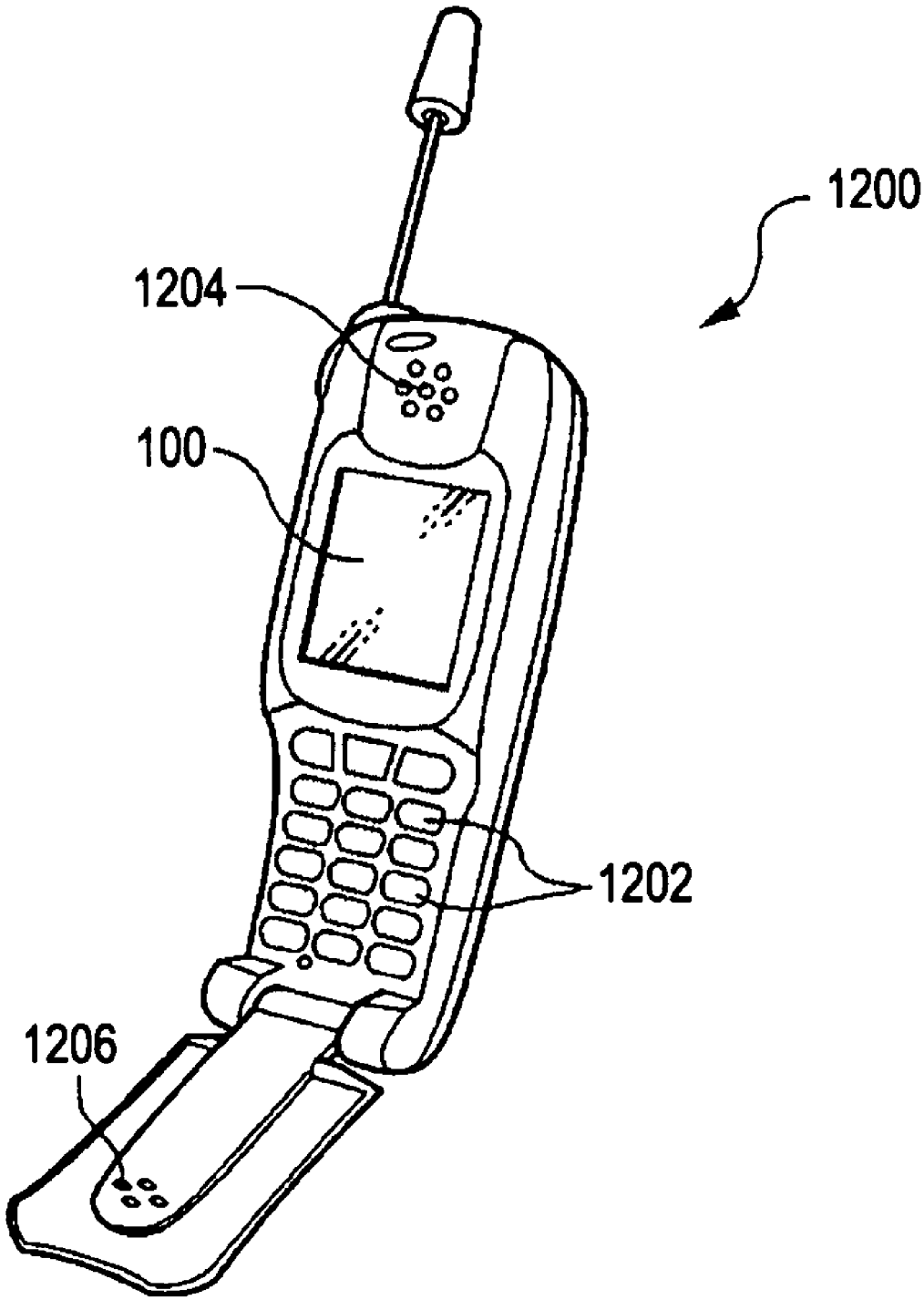
FIG. 21 is a diagram showing the structure of a portable phone incorporating the electrooptic device according to an embodiment.

An electronic device equipped with the electrooptic device 10 according to the embodiments as a display will now be described. FIG. 21 illustrates the structure of a portable phone 1200 that adopts the electrooptic device 10 according to either of the embodiments.

As illustrated, the portable phone 1200 includes a plurality of operation buttons 1202, an ear piece 1204, a mouthpiece 1206, and the electrooptic device 10. The components of the electrooptic device 10 other than that corresponding to the display region 100 do not appear externally.

Examples of electronic devices incorporating the electrooptic device 10 include, in addition to the portable phone shown in FIG. 21, digital still cameras, notebook computers, liquid crystal televisions, viewfinder (or monitor-direct-view type) videotape recorders, car navigation systems, pagers, electronic notebooks, calculators, word processors, workstations, TV phones, POS terminals, and devices having a touch panel. Obviously, the electrooptic device 10 can be used as the displays of such various electronic devices.

The entire disclosure of Japanese Patent Application No. 2006-237367, filed Sep. 1, 2006 is expressly incorporated by reference herein.

What is claimed is:

1. A driving circuit of an electrooptic device, comprising:

a plurality of scanning lines; a plurality of data lines;

first and second capacitor lines corresponding to each of the plurality of scanning lines;

a common electrode;

pixels corresponding to the intersections of the plurality of scanning lines and the plurality of data lines, the pixels each including:

a pixel switching element connected at one end to a data line corresponding to the element itself, and brought into conduction when a scanning line corresponding to the element itself is selected;

a pixel capacitor disposed between the pixel switching element and the common electrode; and a storage capacitor disposed between one end of the pixel capacitor and one of the first and second capacitor lines corresponding to the scanning line;

a scanning-line driving circuit that selects the scanning lines in a predetermined order;

a capacitor-line driving circuit, when the one scanning line is selected, shifts the voltage of a first capacitor line corresponding to one scanning line to one of higher and lower levels from a predetermined voltage by a predetermined value, and holds the predetermined voltage after a scanning line apart from the one scanning line by a predetermined number of lines is selected until the one scanning line is selected again; and when the one scanning line is selected, shifts the voltage of a second capacitor line corresponding to the one scanning line to the other one of higher and lower levels from the predetermined voltage by the predetermined value, and holds the predetermined voltage after a scanning line apart from the one scanning line by a predetermined number of lines is selected until the one scanning line is selected again;

a data-line driving circuit that applies a data signal to pixels corresponding to a selected scanning line via a data line, the data signal having a voltage corresponding to the gray level of the pixels corresponding to the selected scanning line, wherein when the one scanning line is selected, the capacitor- line driving circuit connects the first capacitor line corresponding to the one scanning line to one of a first feed line that feeds a first capacitance signal and a second feed line that feeds a second capacitance signal;

connects the second capacitor line corresponding to the one scanning line to the other one of the first feed line and the second feed line; and connects the first capacitor line and the second capacitor line to a third feed line after a scanning line apart from the one scanning line by a predetermined number of lines is selected until the one scanning line is selected again, wherein the capacitor-line driving circuit comprises:

first to sixth transistors corresponding to each row, wherein the gate electrode of the first transistor corresponding to each of the first and second capacitor lines is connected to a scanning line corresponding to the one scanning line, and the source electrode of the first transistor is connected to one of the first and second feed lines;

the gate electrode of the second transistor is connected to the scanning line corresponding to the one scanning line, and the source electrode of the second transistor is connected to the other one of the first and second feed lines;

the source electrodes of the third and fourth transistors are connected to the third feed line;

the gate electrode of the fifth transistor is connected to the scanning line corresponding to the one capacitor line, and the source electrode of the fifth transistor is connected to an off-voltage feed line that feeds off-voltage for turning off the third and fourth transistors;

the gate electrode of the sixth transistor is connected to a scanning line apart from the scanning line corresponding to the one capacitor line by a predetermined lines, and the source electrode of the sixth transistor is connected to an on-voltage feed line that feeds on-voltage for turning on the third and fourth transistors; and the drain electrodes of the first and third transistors are connected to the first capacitor line corresponding to the line, the drain electrodes of the second and fourth transistors are connected to the second capacitor line corresponding to the line, and the drain electrodes of the fifth and sixth transistors are connected to the gate electrodes of the third and fourth transistors.

2. The driving circuit of an electrooptic device according to claim 1, wherein:

in the pixels corresponding to the plurality of scanning lines, storage capacitors corresponding odd-numbered columns are each disposed between one end of a pixel capacitor corresponding to the pixel itself and the first capacitor line; and storage capacitors corresponding to even-numbered columns are each disposed between one end of a pixel capacitor corresponding to the pixel itself and the second capacitor line.

3. An electrooptic device comprising:

a plurality of scanning lines;

a plurality of data lines;

first and second capacitor lines corresponding to each of the plurality of scanning lines;

a common electrode;

pixels corresponding to the intersections of the plurality of scanning lines and the plurality of data lines, the pixels each including:

a pixel switching element connected at one end to a data line corresponding to the element itself, and brought into conduction when a scanning line corresponding to the element itself is selected;

a pixel capacitor disposed between the pixel switching element and the common electrode; and a storage capacitor disposed between one end of the pixel capacitor and one of the first and second capacitor lines corresponding to the scanning line;

a scanning-line driving circuit that selects the scanning lines in a predetermined order;

a capacitor-line driving circuit, when the one scanning line is selected, shifts the voltage of a first capacitor line corresponding to one scanning line to one of higher and lower levels from a predetermined voltage by a predetermined value, and holds the predetermined voltage after a scanning line apart from the one scanning line by a predetermined number of lines is selected until the one scanning line is selected again; and when the one scanning line is selected, shifts the voltage of a second capacitor line corresponding to the one scanning line to the other one of higher and lower level is from the predetermined voltage by the predetermined value, and holds the predetermined voltage after a scanning line apart from the one scanning line by a predetermined number of lines is selected until the one scanning line is selected again;

a data-line driving circuit that applies a data signal to pixels corresponding to a selected scanning line via a data line, the data signal having a voltage corresponding to the gray level of the pixels corresponding to the selected scanning line, wherein when the one scanning line is selected, the capacitor- line driving circuit connects the first capacitor line corresponding to the one scanning line to one of a first feed line that feeds a first capacitance signal and a second feed line that feeds a second capacitance signal;

connects the second capacitor line corresponding to the one scanning line to the other one of the first feed line and the second feed line; and connects the first capacitor line and the second capacitor line to a third feed line after a scanning line apart from the one scanning line by a predetermined number of lines is selected until the one scanning line is selected again, wherein the capacitor-line driving circuit comprises:

first to sixth transistors corresponding to each row, wherein the gate electrode of the first transistor corresponding to each of the first and second capacitor lines is connected to a scanning line corresponding to the one scanning line, and the source electrode of the first transistor is connected to one of the first and second feed lines;

the gate electrode of the second transistor is connected to the scanning line corresponding to the one scanning line, and the source electrode of the second transistor is connected to the other one of the first and second feed lines;

the source electrodes of the third and fourth transistors are connected to the third feed line;

the gate electrode of the fifth transistor is connected to the scanning line corresponding to the one capacitor line, and the source electrode of the fifth transistor is connected to an off-voltage feed line that feeds off-voltage for turning off the third and fourth transistors;

the gate electrode of the sixth transistor is connected to a scanning line apart from the scanning line corresponding to the one capacitor line by a predetermined lines, and the source electrode of the sixth transistor is connected to an on-voltage feed line that feeds on-voltage for turning on the third and fourth transistors; and the drain electrodes of the first and third transistors are connected to the first capacitor line corresponding to the line, the drain electrodes of the second and fourth transistors are connected to the second capacitor line corresponding to the line, and the drain electrodes of the fifth and sixth transistors are connected to the gate electrodes of the third and fourth transistors.

4. An electronic device comprising the electrooptic device according to claim 3.

* * * * *